US008967615B2

(12) United States Patent
Takaishi et al.

(10) Patent No.: US 8,967,615 B2
(45) Date of Patent: Mar. 3, 2015

(54) REVERSING TRANSPORTING DEVICE, IMAGE FORMING APPARATUS, AND TRANSPORTING DEVICE

(75) Inventors: Yoshiyuki Takaishi, Kanagawa (JP); Michio Tada, Kanagawa (JP); Takashi Abe, Kanagawa (JP); Akira Iwasaka, Kanagawa (JP); Toshitaka Tanaka, Kanagawa (JP); Hiroyuki Momiyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 55 days.

(21) Appl. No.: 13/247,341

(22) Filed: Sep. 28, 2011

(65) Prior Publication Data

US 2012/0248680 A1 Oct. 4, 2012

(30) Foreign Application Priority Data

Mar. 29, 2011 (JP) ..... 2011-072643

(51) Int. Cl.

| | |
|---|---|
| ***B65H 29/00*** | (2006.01) |
| ***G03G 15/23*** | (2006.01) |
| ***B65H 5/06*** | (2006.01) |
| ***B65H 85/00*** | (2006.01) |
| ***G03G 15/01*** | (2006.01) |

(52) U.S. Cl.

CPC ..... *G03G 15/234* (2013.01); *B65H 5/062* (2013.01); *B65H 85/00* (2013.01); *G03G 15/0189* (2013.01); *B65H 2301/3122* (2013.01); *B65H 2301/33212* (2013.01); *B65H 2301/33224* (2013.01); *B65H 2402/441* (2013.01); *B65H 2404/13171* (2013.01); *B65H 2404/133* (2013.01); *B65H 2404/1441* (2013.01); *B65H 2404/6111* (2013.01); *B65H 2404/694* (2013.01); *G03G 2215/0125* (2013.01)

USPC ..... 271/184; 271/186; 399/364

(58) Field of Classification Search

USPC ..... 271/184, 185, 186; 399/364

See application file for complete search history.

(56) References Cited

U.S. PATENT DOCUMENTS

| | | | | |
|---|---|---|---|---|
| 4,019,435 | A * | 4/1977 | Davis | 101/232 |
| 4,848,765 | A * | 7/1989 | Torii | 271/274 |
| 5,042,791 | A * | 8/1991 | Stemmle | 271/186 |
| 5,052,678 | A * | 10/1991 | Looney | 271/186 |
| 5,205,551 | A * | 4/1993 | Nagano et al. | 271/225 |
| 5,666,629 | A * | 9/1997 | Kazoh | 399/401 |
| 6,032,945 | A * | 3/2000 | Miura | 271/122 |
| 6,554,276 | B2 | 4/2003 | Jackson et al. | |
| 6,607,320 | B2 | 8/2003 | Bobrow et al. | |

(Continued)

FOREIGN PATENT DOCUMENTS

| | | |
|---|---|---|
| JP | A-2006-56624 | 3/2006 |
| JP | 2011-057381 A | 3/2011 |

OTHER PUBLICATIONS

Dec. 2, 2014 Office Action issued in Japanese Application No. 2011-072643.

*Primary Examiner* — Ernesto Suarez
(74) *Attorney, Agent, or Firm* — Oliff PLC

(57) ABSTRACT

A reversing transporting device includes a transport-in path, a first transporting section provided at the transport-in path, a second transporting section provided at the transport-in path, a reversing path connected to the transport-in path, a third transporting section provided at the reversing path, a transport-out path connected to the reversing path, a fourth transporting section provided at the transport-out path, and a fifth transporting section provided at the transport-out path.

6 Claims, 15 Drawing Sheets

(56) References Cited

U.S. PATENT DOCUMENTS 7,726,648 B2 * 6/2010 Tamura et al. ..... 271/176
8,052,136 B2 * 11/2011 Sato et al. ..... 271/9.13
8,437,684 B2 * 5/2013 Mizuno et al. ..... 399/401

* cited by examiner

REVERSING TRANSPORTING DEVICE, IMAGE FORMING APPARATUS, AND TRANSPORTING DEVICE

CROSS-REFERENCE TO RELATED APPLICATIONS

This application is based on and claims priority under 35 USC 119 from Japanese Patent Application No. 2011-072643 filed Mar. 29, 2011.

BACKGROUND

(i) Technical Field

The present invention relates to a reversing transporting device, an image forming apparatus, and a transporting device.

SUMMARY

According to an aspect of the invention, there is provided a reversing transporting device including a transport-in path for transporting a recording material into the reversing transporting device, the recording material having a first side, a second side, a front side, and a back side, the second side being positioned opposite to the first side, the front side intersecting the first side, the back side being positioned opposite to the front side; a first transporting section provided at the transport-in path, the first transporting section nipping the recording material that is transported into the reversing transporting device, and transporting the recording material in a first direction in which the front side of the recording material is a leading side; a second transporting section provided at the transport-in path, the second transporting section nipping the recording material that is transported by the first transporting section, and transporting the recording material in a second direction in which the first side of the recording material is a leading side; a reversing path connected to the transport-in path, the reversing path guiding the recording material that is transported by the second transporting section so that the first side and the second side of the recording material are reversed, to cause front and back surfaces of the recording material to be reversed; a third transporting section provided at the reversing path, the third transporting section transporting the recording material that is transported by the second transporting section in a third direction in which the first side is the leading side; a transport-out path connected to the reversing path, the transport-out path being for transporting out of the reversing transporting device the recording material that is transported in a state in which the front and back surfaces of the recording material are reversed by the reversing path and third transporting section; a fourth transporting section provided at the transport-out path, the fourth transporting section nipping the recording material that is transported by the third transporting section, and transporting the recording material in a fourth direction in which the first side is the leading side; and a fifth transporting section provided at the transport-out path, the fifth transporting section nipping the recording material that is transported by the fourth transporting section, and transporting the recording material in a fifth direction in which the front side of the recording material is the leading side. The first transporting section and the second transporting section each have a pair of rotating members contactably and separably disposed with the transport-in path being interposed therebetween. The fourth transporting section and the fifth transporting section each have a pair of rotating members contactably and separably disposed with the transport-out path being interposed therebetween. Each pair of rotating members includes a driving rotating member and a driven rotating member, the driving rotating member rotating by receiving outside driving force, the driven rotating member rotating by receiving the driving force from the driving rotating member when the driven rotating member is contacted by the driving rotating member. When the driving rotating members and the respective driven rotating members are separated from each other, in the first transporting section and the second transporting section, the driving rotating members retreat from the transport-in path, and, in the fourth transporting section and the fifth transporting section, the driving rotating members retreat from the transport-out path.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereunder be described in detail with reference to the attached drawings.

First Exemplary Embodiment

Figure 1:
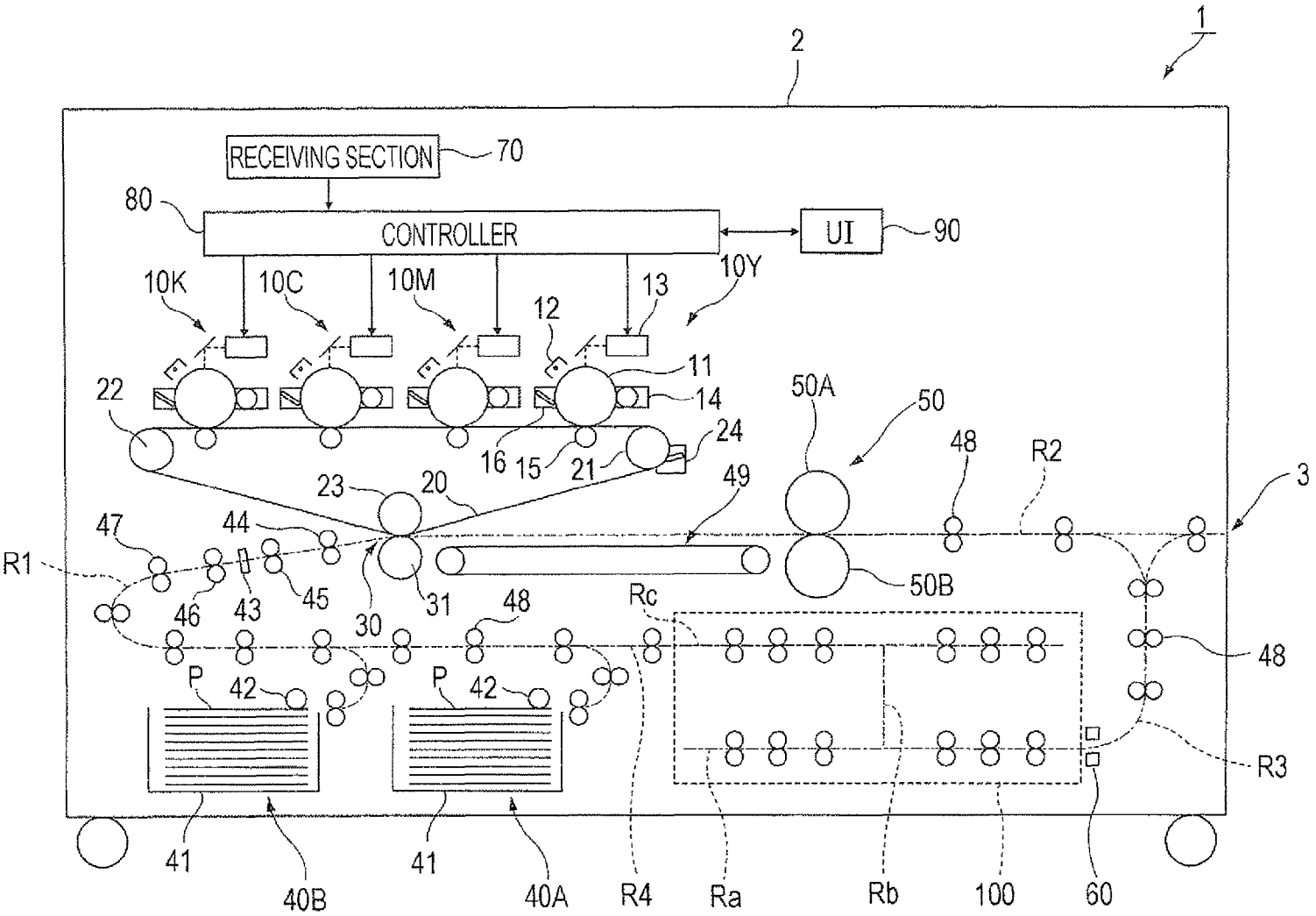
FIG. 1 shows an image forming apparatus to which an exemplary embodiment is applied as seen from a near side.

FIG. 1 shows an image forming apparatus 1 to which an exemplary embodiment is applied as seen from a near side. The image forming apparatus 1 shown in FIG. 1 includes what is called a tandem structure. The image forming apparatus 1 includes image forming units 10 (10Y, 10M, 10C, and 10K) that form toner images of respective color components by electrophotography. The image forming apparatus 1 further includes, for example, a central processing unit (CPU), read only memory (ROM), and random access memory (RAM). The image forming apparatus 1 includes each device that forms the image forming apparatus 1 and a controller 80 serving as an exemplary stopping unit that controls the operation of each section. The image forming apparatus 1 further includes, for example, a touch panel and a user interface (UI) 90 that outputs an instruction received from a user to the controller 90 and that indicates to the user information from the controller 80. Still further, the image forming apparatus 1 includes a receiving section 70 that receives, for example, image data from, for example, a personal computer (PC) or an image reading device (scanner).

Still further, the image forming apparatus 1 includes an intermediate transfer belt 20 and a second transfer device 30. The toner images of the respective color components that are formed by the respective image forming units 10 are successively transferred to the intermediate transfer belt 20 by first transfer operations and held by the intermediate transfer belt 20. The second transfer device 30 transfers the toner images on the intermediate transfer belt 20 by one second transfer operation to a sheet P serving as an exemplary rectangular recording material.

Each image forming unit 10 serving as an exemplary image forming section includes a rotatably mounted photoconductor drum 11. In each image forming unit 10, a charging device 12 that charges the photoconductor drum 11, an exposure device 13 that exposes the photoconductor drum 11 to form an electrostatic latent image, and a developing device 14 that makes visible the electrostatic latent image on the photoconductor drum 11 by toner are provided around the photoconductor drum 11. Each image forming unit 10 includes a first transfer device 15 and a drum cleaning device 16. The first transfer devices 15 transfer to the intermediate transfer belt 20 the toner images of the respective color components formed on the respective photoconductor drums 11. The drum cleaning devices 16 remove residual toner on the respective photoconductor drums 11.

Next, the intermediate transfer belt 20 is placed around three rotatably provided rollers 21 to 23 so as to be rotatably provided. Of the three rollers 21 to 23, the roller 22 drives the intermediate transfer belt 20. The roller 23 is disposed so as to oppose a second transfer roller 31 with the intermediate transfer belt 20 being disposed therebetween. The second transfer roller 31 and the roller 23 constitute the second transfer device 30. A belt cleaning device 24 that removes residual toner on the intermediate transfer belt 20 is provided at a position opposing the roller 21 with the intermediate transfer belt 20 being disposed therebetween.

A first transport path R1, a second transport path R2, a third transport path R3, and a fourth transport path R4 are provided in the image forming apparatus 1. A sheet P transported towards the second transfer device 30 passes along the first transport path R1. The sheet P that has passed the second transfer device 30 passes along the second transport path R2. The third transport path R3 is branched from the second transport path R2 at a location that is downstream from a fixing device 50 (described later), extends below the first transport path R1, and guides the sheet P to a sheet reversing device 100 (described later). The fourth transport path R4 guides again the sheet P that has passed the sheet reversing device 100 (described later) to the first transport path R1. The sheet P is transported along the first transport path R1 to the fourth transport path R4 so that two opposing sides among the four sides of the sheet P (a first side and a second side that is positioned opposite to the first side) move along these transport paths R1 to R4.

The image forming apparatus 1 according to the exemplary embodiment further includes the sheet reversing device 100 that reverses the front and back of the sheet P that has been transported therein from the third transport path R3, and that transports out the sheet P to the fourth transport path R4. The sheet reversing device 100 reverses the sheet P around an axis along a sheet transport direction in the third transport path R3 and a sheet transport direction in the first transport path R1. That is, the sheet reversing device 100 according to the exemplary embodiment reverses the two side ends (sides) of the sheet P without reversing the front end and the back end of the sheet P in the sheet transport direction. The sheet reversing device 100 includes a transport-in path Ra, a transport-out path Rc, and a reversing path Rb. The transport-in path Ra is connected to the third transport path R3. The transport-out path Rc is connected to the fourth transport path R4. The reversing path Rb reverses the front and back of the sheet P supplied from the transport-in path Ra, and supplies the sheet P to the transport-out path Rc.

A sheet detecting sensor 60 detects the passage of the sheet P is mounted at the third transport path R3 corresponding to a sheet-P transporting-in side in the sheet reversing device 100.

Further, in the exemplary embodiment, an opening 3 is formed in a housing 2 of the image forming apparatus 1. Here, among sheets P transported along the second transport path R2, the sheets P that are not guided to the third transport path R3 are discharged outside the housing 2 from the opening 3, and are stacked on a sheet stacking section (not shown). It is possible to provide a processing device (not shown) adjacent to the housing 2, and, for example, punch out holes in the sheets P that are discharged from the opening 3.

The image forming apparatus 1 further includes a first sheet supplying device 40A and a second sheet supplying device 40B. The first sheet supplying device 40A supplies a sheet P to the first transport path R1. The second sheet supplying device 40B is disposed downstream from the first sheet supplying device 40A in the sheet-P transport direction, and supplies a sheet P to the first transport path R1. The first sheet supplying device 40A and the second sheet supplying device 40B have similar structures. The first sheet supplying device 40A and the second sheet supplying device 40B each include a sheet holding section 41 that holds sheets P, and a take-out roller 42 that takes out and transports the sheets P held in the sheet holding section 41.

First transport rollers 44 that transport a sheet P in the first transport path R1 towards the second transfer device 30 is provided at the first transport path R1 and upstream from the second transfer device 30. Further, second transport rollers 45 that transport the sheet P towards the first transport rollers 44, third transport rollers 46 that transport the sheet P towards the second transport rollers 45, and fourth transport rollers 47 that transport the sheet P towards the third transport rollers 46 are provided.

In addition to these transport rollers, transport rollers 48 that transport the sheet P that is positioned in the first transport path R1, the second transport path R2, the third transport path R3, and the fourth transport path R4 are provided at the first transport path R1, the second transport path R2, the third transport path R3, and the fourth transport path R4. The first transport rollers 44, the second transport rollers 45, the third transport rollers 46, the fourth transport rollers 47, and the transport rollers 48 are rotatably provided, and are formed of a pair of rollers that are rotatably provided and that push each other. One of the roller members of each pair is rotationally driven to transport the sheet P.

In the exemplary embodiment, a contact member 43 with which an end of a sheet P contacts is provided between the second transport rollers 45 and the third transport rollers 46. In the exemplary embodiment, when the end of the sheet P contacts the contact member 43, skew of the sheet P (that is, tilting of the sheet P in the transport direction) is corrected. After correcting the skew of the sheet P using the contact member 43, the contact member 43 retreats from the first transport path R1.

The image forming apparatus 1 further includes the fixing device 50 that fixes to this sheet P an image transferred to the sheet P by a second transfer operation by the second transfer device 30. The fixing device 50 includes a heating roller 50A and a pressing roller 50B. The heating roller 50A is heated by a built-in heater (not shown). The pressing roller 50B presses the heating roller 50A. In this fixing device 50, when this sheet P passes a location between the heating roller 50A and the pressing roller 50B, the sheet P is heated and pressed, so that an image on the sheet P is fixed to the sheet P.

A belt transporting section 49 that transports to the fixing device 50 the sheet P that has passed the second transfer device 30 is provided between the second transfer device 30 and the fixing device 50. The belt transporting section 49 includes a belt that rotates. The sheet P is placed on the belt to transfer the sheet P. In the exemplary embodiment, for example, the transport rollers that are provided at the first transport path R1, the second transport path R2, the third transport path R3, and the fourth transport path R4 function as transporting units.

In the image forming apparatus 1 according to the exemplary embodiment, in addition to being possible to form an mage on a first surface of the sheet P supplied from the first sheet supplying device 40A, etc., it is possible to form an image on a second surface of the sheet P. In the image forming apparatus 1, the front and back of the sheet P that has passed the fixing device 50 are reversed, so that the sheet P with its front and back reversed is transported again to the second transfer device 30. Thereafter, the second transfer device 30 transfers an image P to the second surface of the sheet P. Thereafter, the sheet P passes the fixing device 50 again, and the transferred image is fixed to the sheet P. By this, not only is the image formed on the first surface of the sheet P, but also the image is formed on the second surface of the sheet P.

Figure 2:
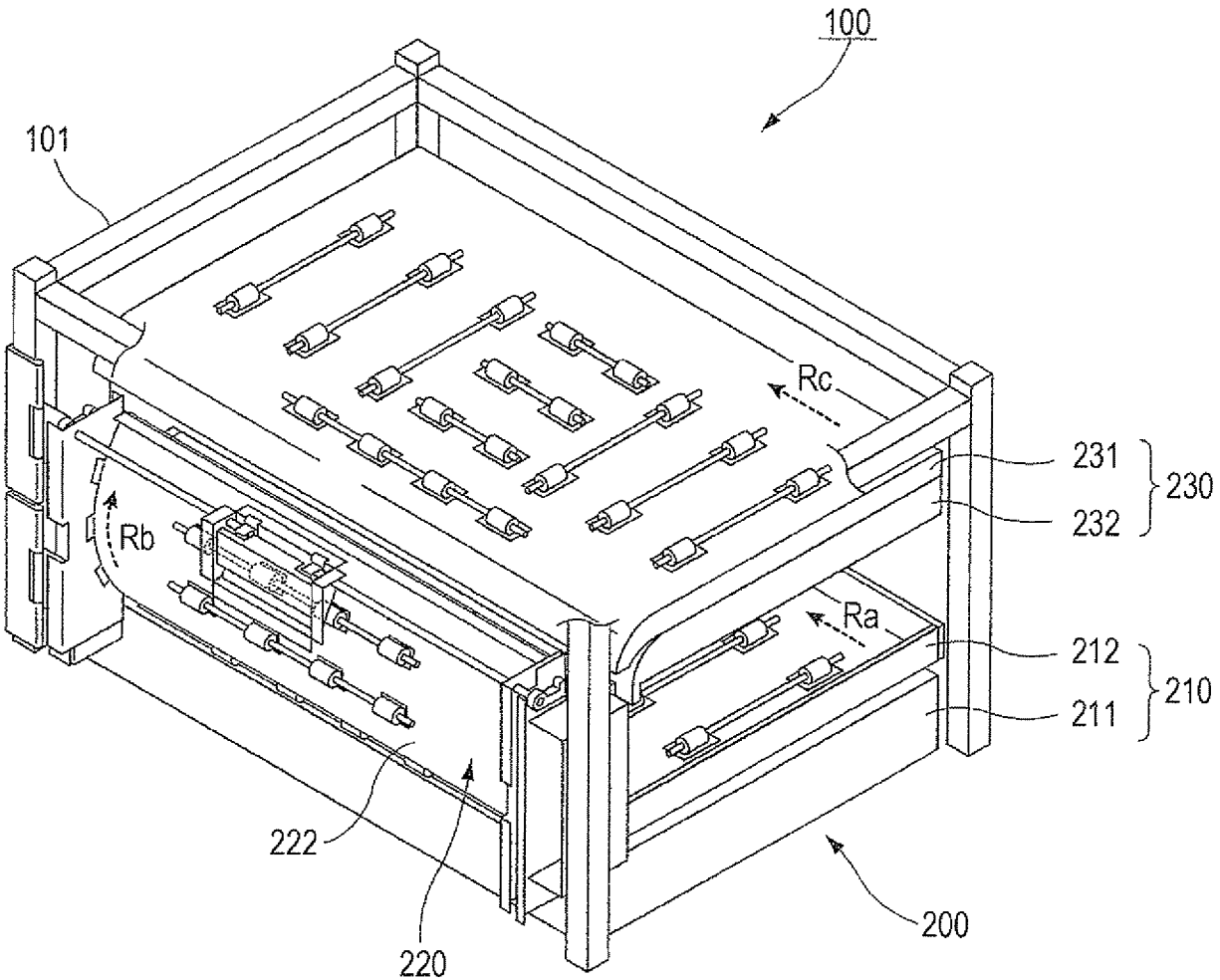
FIG. 2 is a perspective view of an entire structure of a sheet reversing device.

FIG. 2 is a perspective view of an entire structure of the sheet reversing device 100 shown in FIG. 1.

The sheet reversing device 100 according to the exemplary embodiment, serving as an exemplary reversing transporting device or a reversing transporting section, includes a frame member 101 and a sheet guiding section 200. The frame member 101 includes four support columns and stays connected to the respective support columns. The sheet guiding section 200 is mounted to the frame member 101 and is used for reversing and transporting a sheet P.

Of the frame member 101 and the sheet guiding section 200, the sheet guiding section 200 includes a transporting-in section 210, a reversing section 220, and a transporting-out section 230. The transporting-in section 210 causes a sheet to be transported into the sheet guiding section 200 from the third transport path R3. The reversing section 220 reverses the front and back of the sheet P transported from the transporting-in section 210. The transporting-out section 230 transports the sheet P transported from the reversing section 220 out to the fourth transport path R4. Here, in the exemplary embodiment, the transporting-out section 230 is disposed above the transporting-in section 210. In addition, as viewed from above the sheet guiding section 200, the transporting-out section 230 and the transporting-in section 210 overlap each other. The reversing section 200 is disposed on the near side of the transporting-in section 210 and the transporting-out section 230 in FIG. 2, that is, the reversing section 200 is disposed on the near side of the image forming apparatus 1 shown in FIG. 1. Therefore, in the sheet reversing device 100, a space is formed between the transporting-in section 210 and the transporting-out section 230 of the sheet guiding section 200. In the exemplary embodiment, the transporting-in section 210 and the transporting-out section 230 function as exemplary transporting devices.

The transport-in path Ra for receiving a sheet P from the third transport path R3 is provided in the transporting-in section 210. The reversing path Rb for receiving the sheet P from the transport-in path Ra is provided in the reversing section 220. The transport-out path Rc for receiving the sheet P from the reversing path Rb and transferring the received sheet P to the fourth transport path R4 is provided in the transporting-out section 230. Therefore, in the sheet guiding section 200, the transport-in path Ra, the reversing path Rb, and the transport-out path Rc are connected to each other to form a continuous transport path.

Here, the transporting-in section 210 includes a first transporting-in guiding plate 211 and a second transporting-in guiding plate 212, which form the transport-in path Ra by being disposed so as to oppose each other. In the exemplary embodiment, the first transporting-in guiding plate 211 is disposed at the outer side (lower side) of the sheet reversing device 100 as viewed from the second transporting-in guiding plate 212. The aforementioned space is formed above the second transporting-in guiding plate 212.

The reversing section 220 includes a first reversing guiding plate 221 (refer to FIGS. 4 to 8 described later) and a second reversing guiding section 22, which form the reversing path Rb by being disposed so as to oppose each other. In the exemplary embodiment, the second reversing guiding plate 222 is positioned at the outer side of the sheet reversing device 100 as viewed from the first reversing guiding plate 221. Of sides of the second reversing guiding plate 222, the side that is opposite to the first reversing guiding plate 221 is where the aforementioned space is formed.

Further, the transporting-out section 230 includes a first transporting-out guiding plate 231 and a second transporting-out guiding plate 232, which form the transport-out path Rc by being disposed so as to oppose each other. In the exemplary embodiment, the first transporting-out guiding plate 231 is positioned at the outer side (upper side) of the sheet reversing device 100 as viewed from the second transporting-out guiding plate 232. The aforementioned space is formed below the second transporting-out guiding plate 232.

The transporting-in section 210, the reversing section 220, and the transporting-out section 230 are each provided with transporting rollers that transport sheets P. They will be described in detail below.

Figure 3:
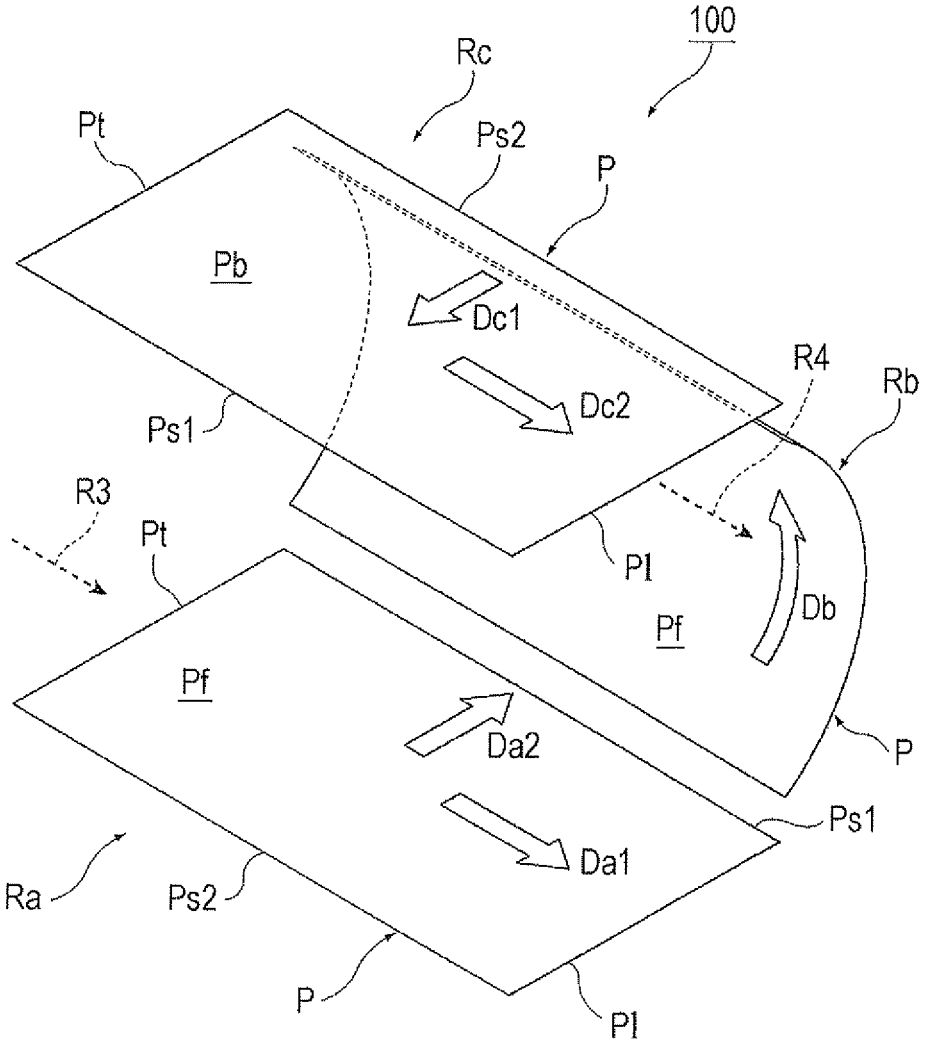
FIG. 3 illustrates the relationship between each transport path provided in the sheet reversing device and a transport direction of a sheet in each transport path.

FIG. 3 illustrates the relationship between each transport path provided in the sheet reversing device 100 and a transport direction of a sheet P in each transport path. The transport paths shown in FIG. 3 correspond to those when the sheet reversing device 100 are viewed obliquely from the inner side.

Here, in the exemplary embodiment, each portion of a sheet P that passes through the sheet reversing device 100 is defined as follows. First, the sheet P is a rectangular sheet. In the sheet P that is transported into the transport-in path Ra from the third transport path R3, a leading end thereof in the transport direction is called a sheet front end Pl, and a trailing end thereof is called a sheet back end Pt. In the sheet P that is transported into the transport-in path Ra from the third transport path R3, a left end thereof in the transport direction is called a sheet first side end Ps1, and a right end side thereof in the transport direction is called a sheet second side end Ps2. Further, in the sheet P that is transported into the transport-in path Ra from the third transport path R3, a surface thereof that faces upward is called a sheet front surface Pf, and a surface thereof that faces downward is called a sheet back surface Pb. In the exemplary embodiment, an image formation surface (aforementioned first surface), where an image is formed by each image forming unit 10, is called the sheet back surface Pb, and the other surface (the aforementioned second surface) is called the sheet front surface Pf.

Here, in the exemplary embodiment, the sheet front end Pl corresponds to a front side, the sheet back end Pt corresponds to a back side, the sheet first side end Ps1 corresponds to a first side, and a sheet second side end Ps2 corresponds to a second side.

With the sheet front surface Pf facing upward, the sheet front end P1 being the leading end, and the sheet back end Pt being the trailing end, the sheet P is transported from the third transport path R3 to the transport-in path Ra in a transporting-in direction Da1 along the sheet first side end Ps1 and the sheet second side end Ps2. With the sheet front surface Pf facing upward, the sheet first side end Ps1 being the leading end, and the sheet second side end Ps2 being the trailing end, the sheet P is transported towards the reversing path Rb from the transport-in path Ra in a transfer direction Da2 along the sheet front end Pl and the sheet back end Pt.

With the sheet front surface Pf facing upward, the sheet first side end Ps1 being the leading end, and the sheet second side end Ps2 being the trailing end, the sheet P is transported to the reversing path Rb from the transport-in path Ra in a reverse direction Db along the sheet front end P1 and the sheet back end Pt. At a boundary between the transport-in path Ra and the reversing path Rb, the transfer direction Da2 and the reversing direction Db are the same direction. Here, the reversing direction Db is a curved (U-shaped) direction. The sheet P is transported through the reversing path Rb so that, when viewed from above the sheet P, its sheet first side end Ps1 and its sheet second side end Ps2 are reversed, and its front and back (sheet front surface Pf and sheet back surface Pb) are reversed. Therefore, with the sheet back surface Pb facing upward, the sheet first side end Ps1 being the leading end, and the sheet second side end Ps2 being the trailing end, the sheet P is transported from the reversing path Rb in the reversing direction Db along the sheet front end Pl and the sheet back end Pt.

With the sheet back surface Pb facing upward, the sheet first side end Ps1 being the leading end, and the sheet second side end Ps2 being the trailing end, the sheet P is transported to the transport-out path Rc from the reversing path Rb in the transfer direction Dc1 along the sheet front end Pl and the sheet back end Pt. At a boundary between the reversing path Rb and the transport-out path Rc, the reversing direction Db and the transfer direction Dc1 are the same direction. With the sheet back surface Pb facing upward, the sheet front end Pl being the leading end, and the sheet back end Pt being the trailing end, the sheet P is transported towards the fourth transport path R4 from the transport-out path Rc in the transport-out direction Dc2 along the sheet first side end Ps1 and the sheet second side end Ps2.

Here, in the exemplary embodiment, the transporting-in direction Da1 corresponds to a first direction, the transfer direction Da2 corresponds to a second direction, the reversing direction Db corresponds to a third direction, the transfer direction Dc1 corresponds to a fourth direction, and the transport-out direction Dc2 corresponds to a fifth direction. The transport-in path Ra and the transport-out path Rc correspond to transport paths. Further, in the transport-in path Ra, the transporting-in direction Da1 corresponds to an input direction, and the transfer direction Da2 corresponds to an output direction. Still further, in the transport-out path Rc, the transfer direction Dc1 corresponds to an input direction, and the transporting-out direction Dc2 corresponds to an output direction.

Accordingly, in the sheet reversing device 100 according to the exemplary embodiment, the sheet P supplied from the transport-in path Ra by supplying the sheet P to the reversing path Rb by reversing the direction of travel of the sheet P supplied from the third transport path R3 by 90 degrees at the transport-in path Ra is rotated by 180 degrees at the reversing path Rb. By this, the front and back of the sheet P are reversed, and the sheet P is supplied to the transport-out path Rc. The direction of travel of the sheet P supplied from the reversing path Rb is reversed by 90 degrees at the transport-out path Rc, and the sheet P is supplied to the fourth transport path R4. At this time, the transporting-in direction Da1 at the transport-in path Ra and the transporting-out direction Dc2 at the transport-out path Rc are the same direction. Before and after the sheet P passes the sheet reversing device 100, the relationship between the sheet front end Pl and the sheet back end Pt in the transport direction does not change, whereas the sheet front surface Pf and the sheet back surface Pb are reversed by reversing the sheet first side end Ps1 and the sheet second side end Ps2 with respect to the transport direction.

Next, the structure of the sheet reversing device 100 will be described in more detail.

Figure 4:
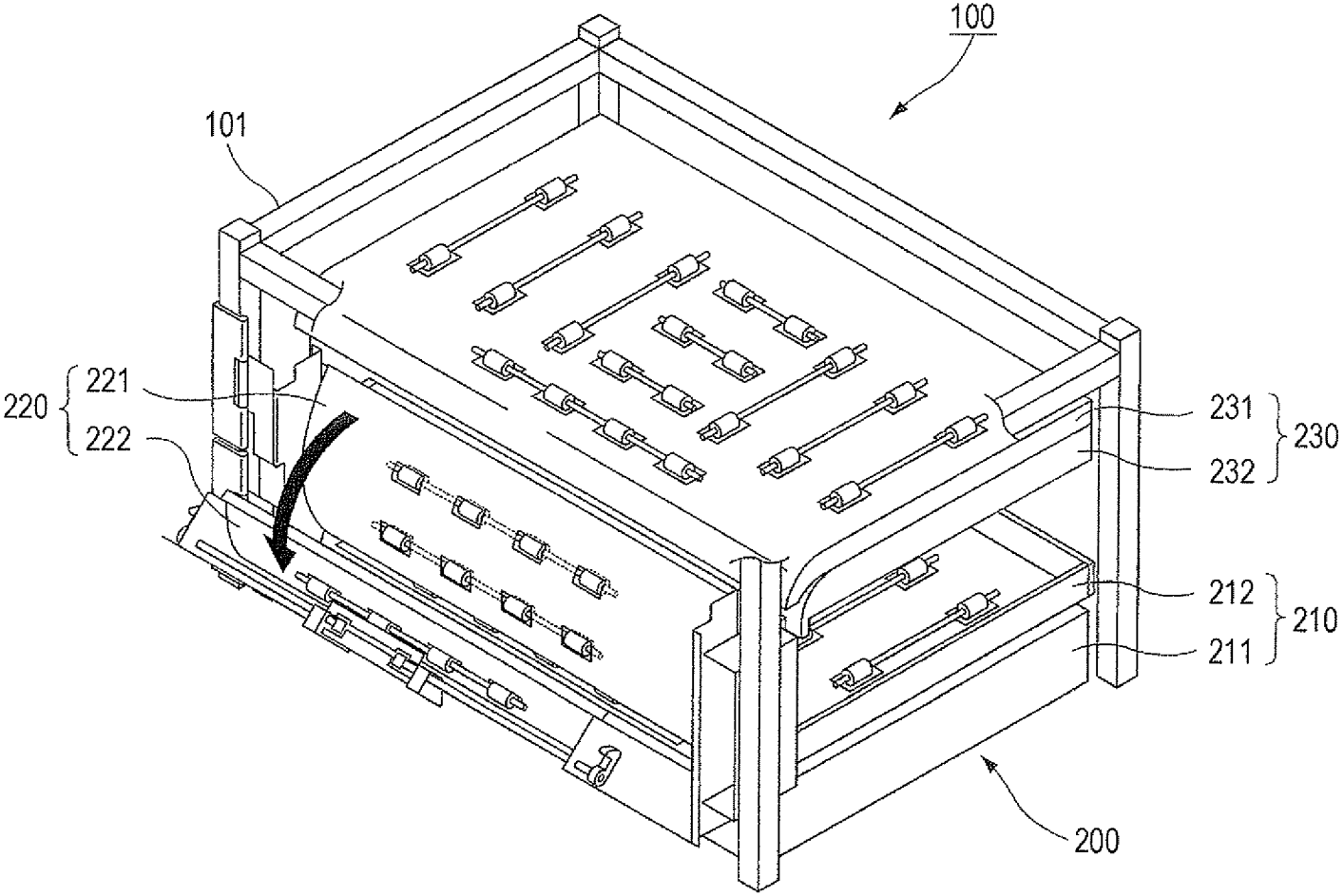
FIG. 4 is a perspective view of a case in which a second reversing guiding plate is set in an open state in the sheet reversing device shown in FIG. 2.

FIG. 4 is a perspective view of a case in which the second reversing guiding plate 222 is set in an open state in the sheet reversing device 100 shown in FIG. 2.

In the exemplary embodiment, in the reversing section 220 of the sheet reversing device 100, the second reversing guiding plate 222 is provided so as to be openable and closable with respect to the first reversing guiding plate 221. Here, the reversing guiding plate 222 is rotatable with respect to a lower side (the transporting-in section 210 side) as an axis. Therefore, when, at the reversing section 220, the second reversing guiding plate 222 is opened with respect to the first reversing guiding plate 221, the reversing path Rb (see FIG. 2), formed by the first reversing guiding plate 221 and the second reversing guiding plate 222, is exposed so as to extend upward at the near side of the sheet reversing device 100 and the image forming apparatus 1 (see FIG. 1).

Figure 5:
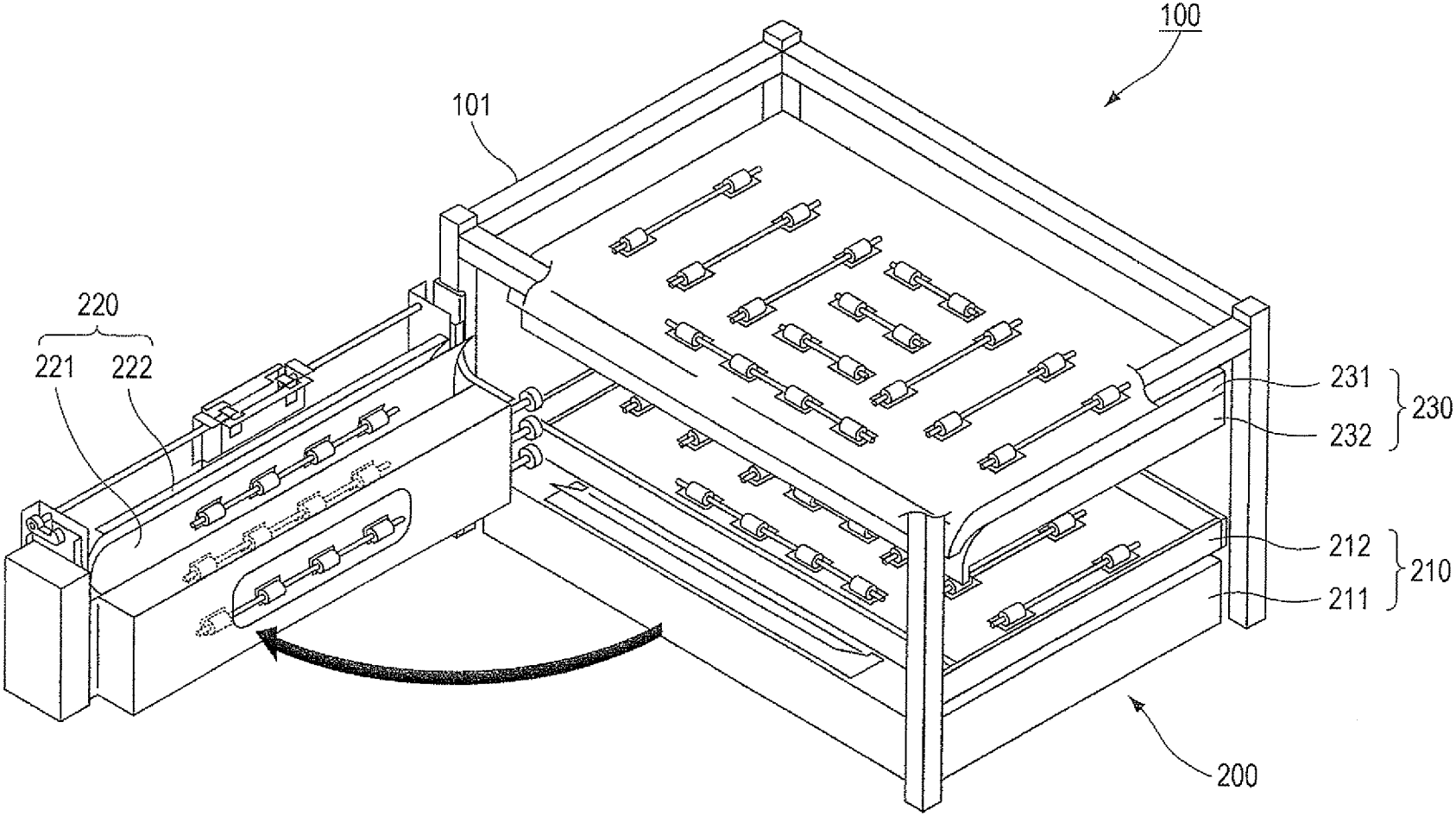
FIG. 5 is a perspective view of a case in which a reversing section is set in an open state in the sheet reversing device shown in FIG. 2.

FIG. 5 is a perspective view of a case in which the reversing section 220 is further set in an open state in the sheet reversing device 100 shown in FIG. 2.

In the exemplary embodiment, the reversing section 220 constituting the sheet reversing device 100 is provided so as to be openable and closable with respect to the frame member 101. Here, the reversing section 220 rotates around columns provided at the illustrated near side and the illustrated inner side of the frame member 101 as axes. Therefore, the sheet reversing device 100, by opening the reversing section 220 with respect to the frame member 101, the space that is formed between the transporting-in section 210 and the transporting-out section 230 of the sheet reversing device 100 is exposed at the near side of the sheet reversing device 100 and the image forming apparatus 1 (see FIG. 1).

Figure 6:
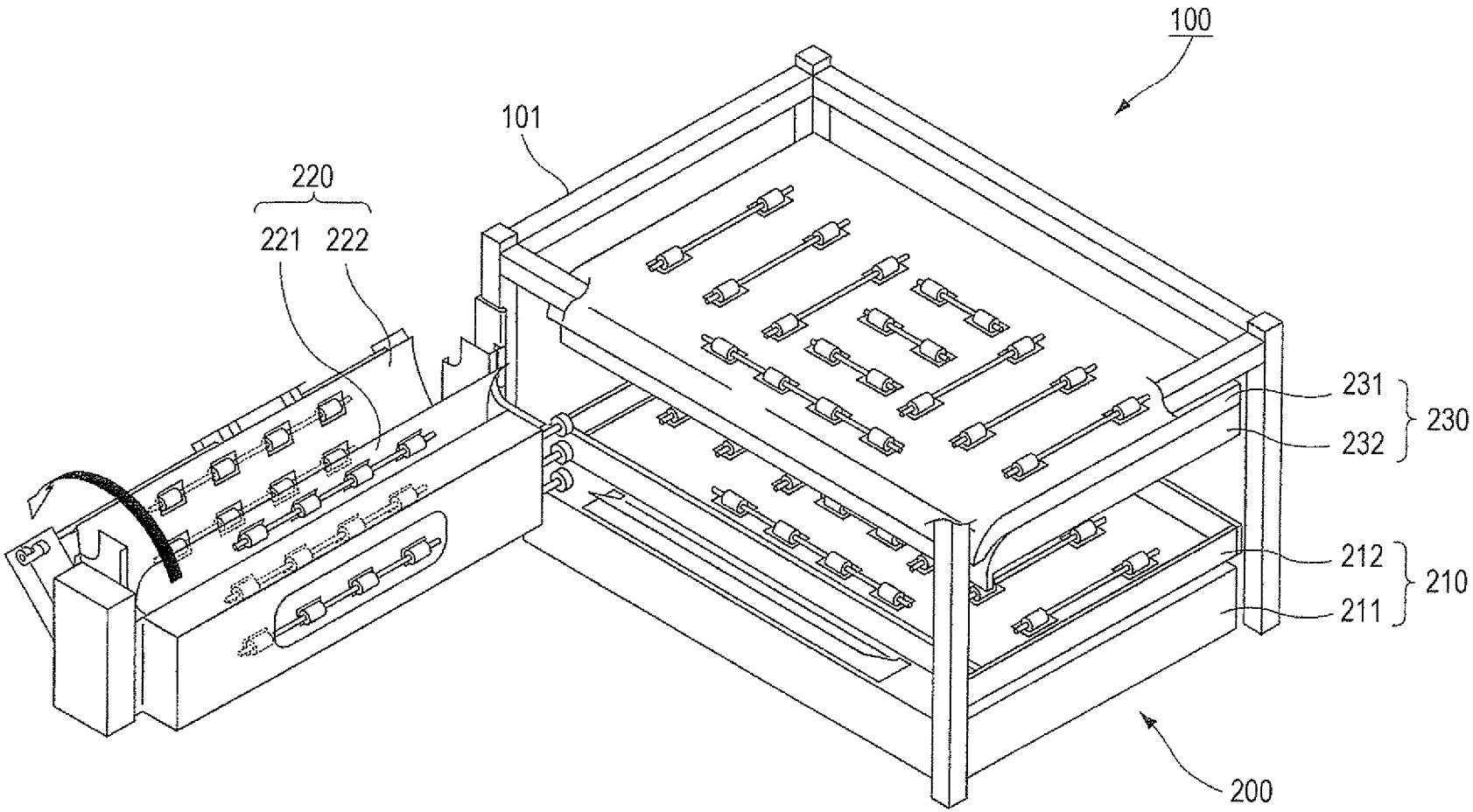
FIG. 6 is a perspective view of a case in which the second reversing guiding plate is set in an open state in the sheet reversing device shown in FIG. 5.

FIG. 6 is a perspective view of a case in which the second reversing guiding plate 222 is set in an open state in the sheet reversing device 100 shown in FIG. 5.

Accordingly, in the sheet reversing device 100 according to the exemplary embodiment, after opening the reversing section 220 with respect to the frame member 101, it is possible to further open the second reversing guiding plate 222 with respect to the first reversing guiding plate 221 in the reversing section 220.

Figure 7:
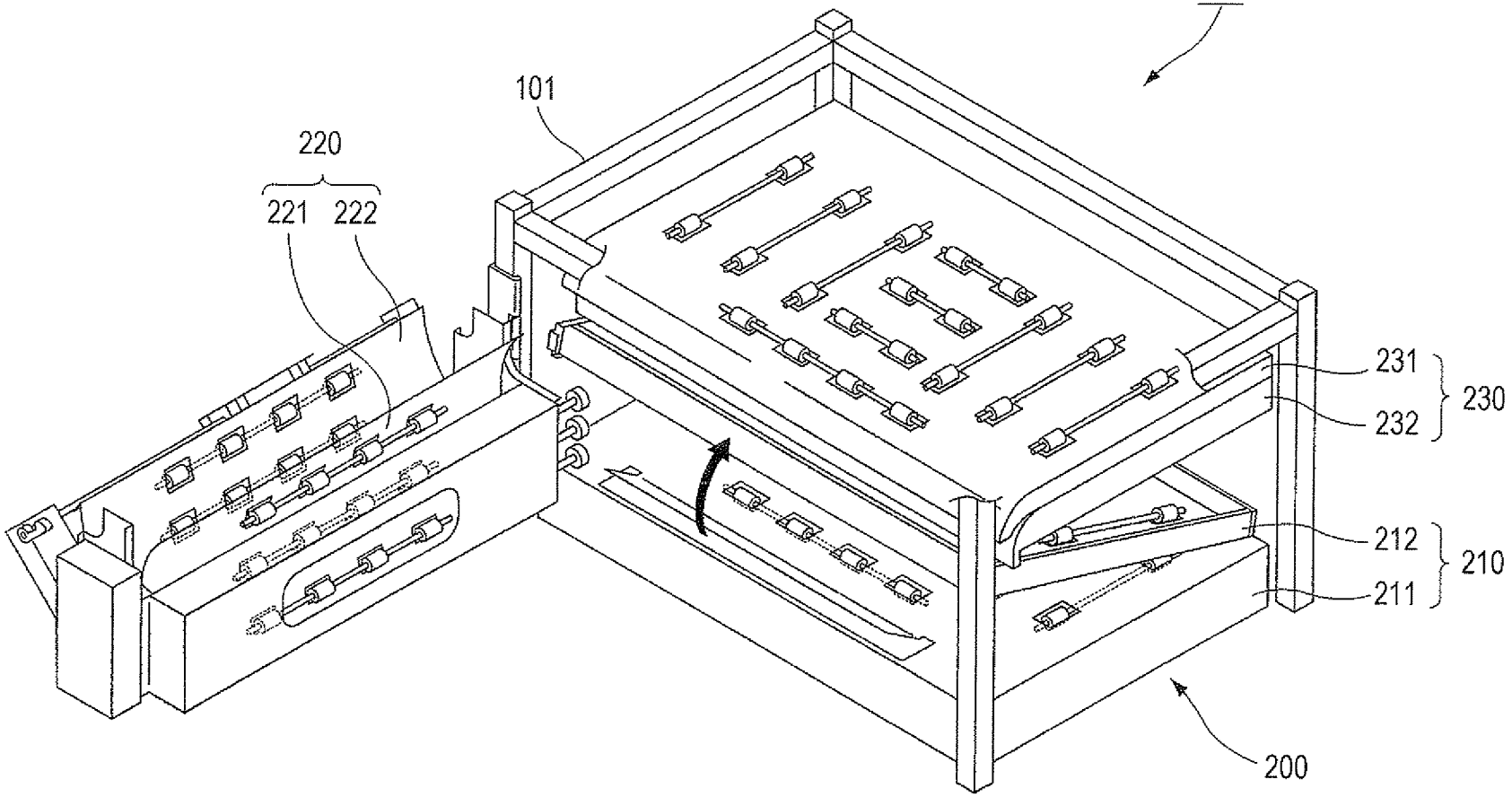
FIG. 7 is a perspective view of a case in which a second transporting-in guiding plate is set in an open state in the sheet reversing device shown in FIG. 6.

FIG. 7 is a perspective view of a case in which the second transporting-in guiding plate 212 is further set in an open state in the sheet reversing device 100 shown in FIG. 6.

In the exemplary embodiment, in the transporting-in section 210 of the sheet reversing device 100, the second transporting-in guiding plate 212 is provided so as to be openable and closable with respect to the first transporting-in guiding plate 211 secured to the frame member 101. Here, the second transporting-in guiding plate 212 rotates with respect to the inner side of the sheet reversing device 100 (serving as the inner side of the image forming apparatus 1 shown in FIG. 1) as an axis. Therefore, in the sheet reversing device 100 whose reversing section 220 is set in an open state, when the second transporting-in guiding plate 212 is opened with respect to the first transporting-in guiding plate 211, the transport-in path Ra (see FIG. 2), formed by the first transporting-in guiding plate 211 and the second transporting-in guiding plate 212, is exposed so as to extend towards the front at the near side of the image forming apparatus 1 and the sheet reversing device 100.

Figure 8:
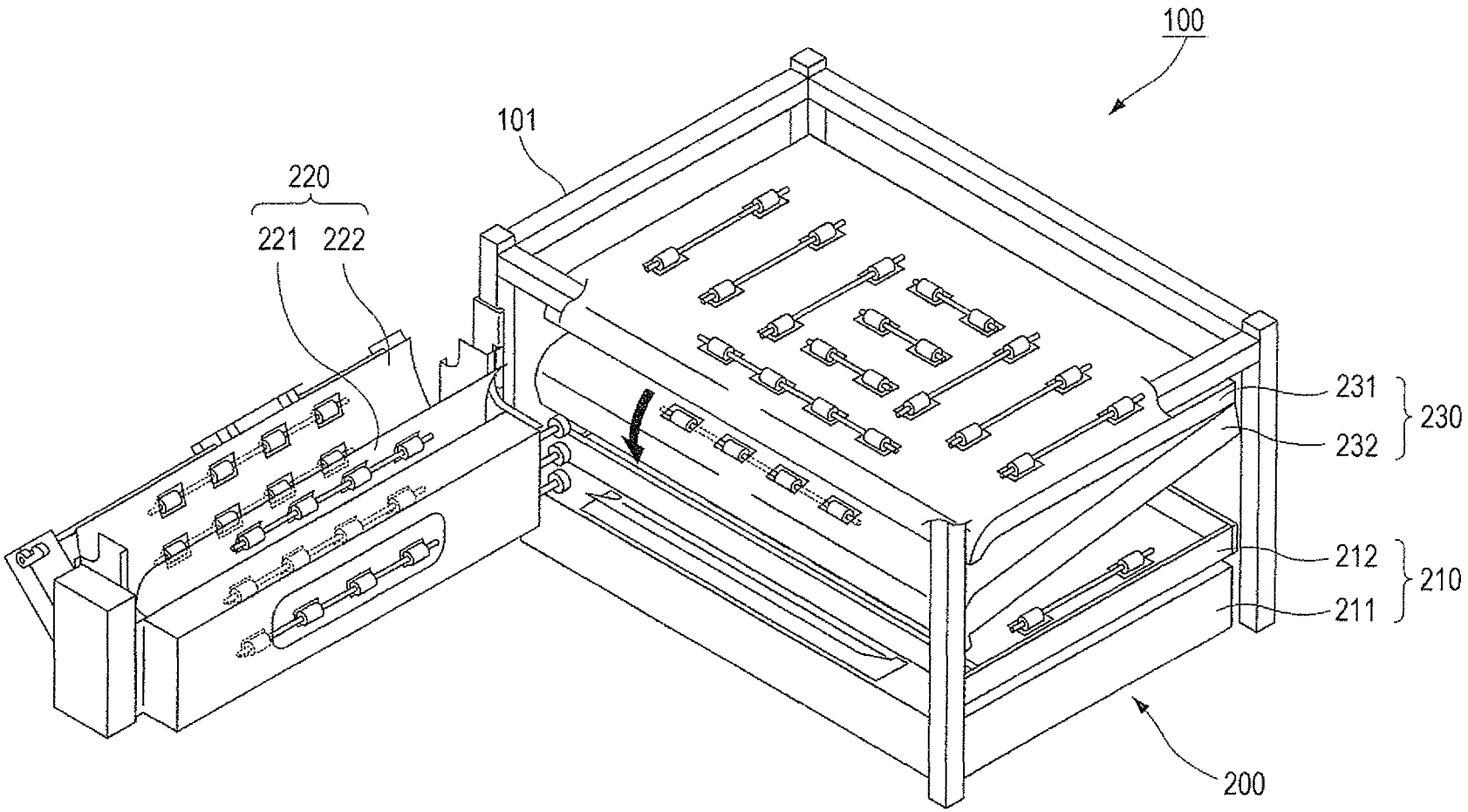
FIG. 8 is a perspective view of a case in which a second transporting-out guiding plate is set in an open state in the sheet reversing device shown in FIG. 6.

FIG. 8 is a perspective view of a case in which the second transporting-out guiding plate 232 is set in an open state in the sheet reversing device 100 shown in FIG. 6.

In the exemplary embodiment, in the transporting-out section 230 of the sheet reversing device 100, the second transporting-out guiding plate 232 is provided so as to be openable and closable with respect to the first transporting-out guiding plate 231 secured to the frame member 101. Here, the second transporting-out guiding plate 232 rotates with respect to the inner side of the sheet reversing device 100 (serving as the inner side of the image forming apparatus 1 shown in FIG. 1) as an axis. Therefore, in the sheet reversing device 100 whose reversing section 220 is set in an open state, when the second transporting-out guiding plate 232 is opened with respect to the first transporting-in guiding plate 231, the transport-in path Rc (see FIG. 2), formed by the first transporting-out guiding plate 231 and the second transporting-out guiding plate 232, is exposed so as to extend towards the front at the near side of the image forming apparatus 1 and the sheet reversing device 100.

Therefore, when a sheet P is jammed at the reversing section 220, the jammed sheet P is capable of being removed by setting the sheet reversing device 100 in, for example, the state shown in FIG. 4. When a sheet P is jammed at the transporting-in section 210, the jammed sheet P is capable of being removed by setting the sheet reversing device 100 in, for example, the state shown in FIG. 7. Further, when a sheet P is jammed at the transporting-out section 230, the jammed sheet P is capable of being removed by setting the sheet reversing device 100 in, for example, the state shown in FIG. 8. A user is capable of removing such jammed sheets by operating respective portions of the sheet reversing device 100 from the near side of the image forming apparatus 1.

A mechanism (not shown) for securing the second transporting-in guiding plate 212 to the first transporting-in guiding plate 211 is mounted to the transporting-in section 210. A mechanism (not shown) for securing the second reversing guiding plate 222 to the first reversing guiding plate 221 is mounted to the reversing section 220. A mechanism (not shown) for securing the second transporting-out guiding plate 232 with respect to the first transporting-out guiding plate 231 is mounted to the transporting-out section 230.

Figure 9:
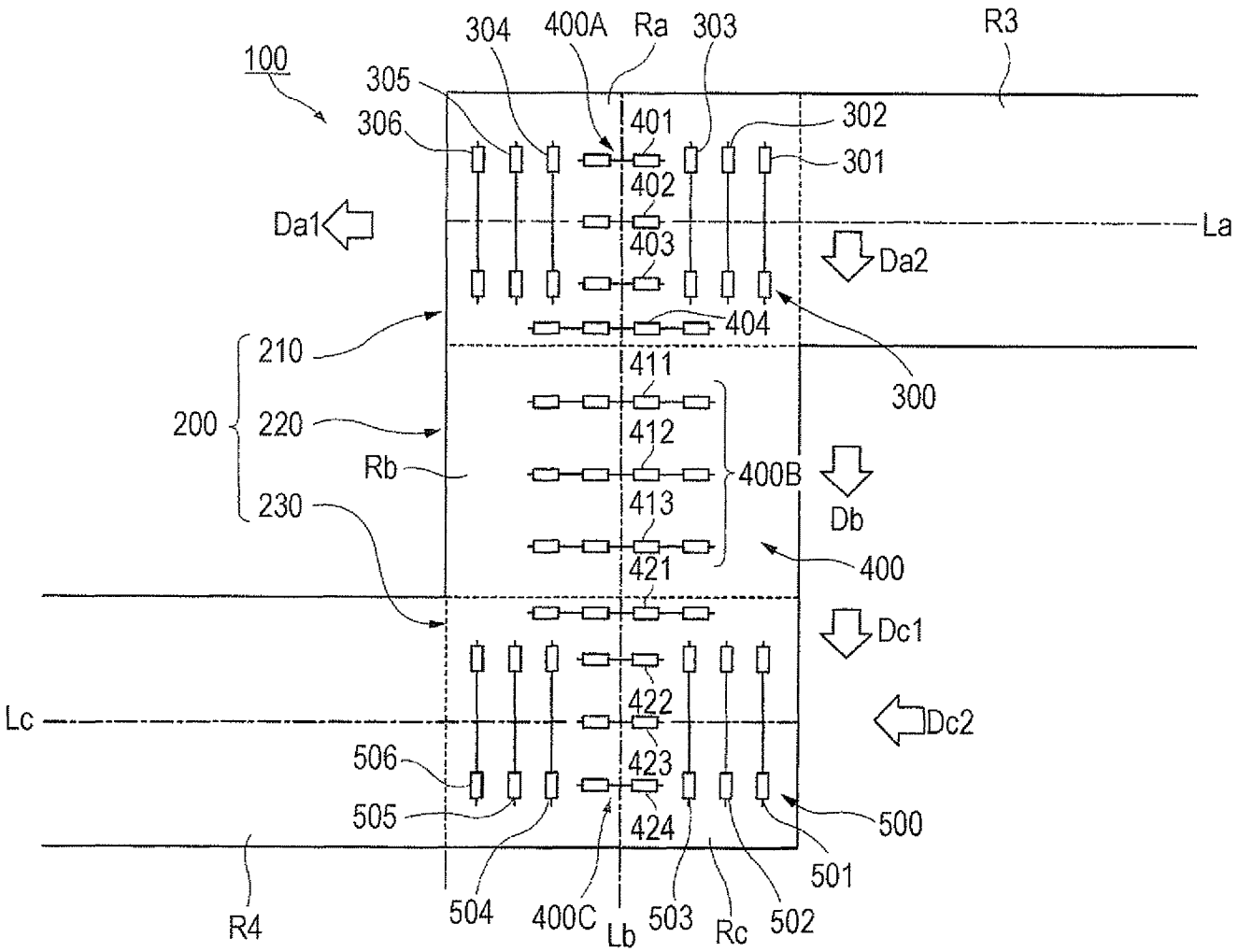
FIG. 9 illustrates the structure of each transporting section and each transport path in the sheet reversing device.

FIG. 9 illustrates the structure of each transporting section and each transport path in the sheet reversing device 100 according to the exemplary embodiment. FIG. 9 is a development plan view of the transport-in path Ra, the reversing path Rb, and the transport-out path Rc in the sheet reversing device 100.

The sheet reversing device 100 includes an upstream-side reversing transporting section 400A and a transporting-in transporting section 300, provided at the transporting-in section 210. The transporting-in transporting section 300 transports a sheet P along the transporting-in direction Da1. The upstream-side reversing transporting section 400A transports a sheet P along the transfer direction Da2. The sheet reversing device 100 further includes a midstream-side reversing transporting section 400B that is provided at the reversing section 220 and that transports a sheet P along the reversing direction Db. The sheet reversing device 100 still further includes a transporting-out transporting section 500 and a downstream-side reversing transporting section 400C, provided at the transporting-out section 230. The downstream-side reversing transporting section 400C transports a sheet P along the transfer direction Dc1. The transporting-out transporting section 500 transports a sheet P along the transport-out direction Dc2. In the exemplary embodiment, the upstream-side reversing transporting section 400A, provided at the transporting-in section 210, the midstream-side reversing transporting section 400B, provided at the reversing section 220, and the downstream-side reversing transporting section 400C, provided at the transporting-out section 230, are collectively called the reversing transporting section 400.

Here, in the exemplary embodiment, the transporting-in transporting section 300 corresponds to a first transporting section, the upstream-side reversing transporting section 400A corresponds to a second transporting section, the midstream-side reversing transporting section 400B corresponds to a third transporting section, the downstream-side reversing transporting section 400C corresponds to a fourth transporting section, and the transporting-out transporting section 500 corresponds to a fifth transporting section. In the transporting-in section 210, the transporting-in transporting section 300 corresponds to an input-side transporting section, and the upstream-side reversing transporting section 400A corresponds to an output-side transporting section. Further, in the transporting-out section 230, the downstream-side reversing transporting section 400C corresponds to an input-side transporting section, and the transporting-out transporting section 500 corresponds to an output-side transporting section.

Of these sections, the transporting-in transporting section 300, provided at the transporting-in section 210, includes, from an upstream side in the transport-in direction Da1, a first transporting-in roller pair 301 (situated closest to the third transport path R3), a second transporting-in roller pair 302, a third transporting-in roller pair 303, a fourth transporting-in roller pair 304, a fifth transporting-in roller pair 305, and a sixth transporting-in roller pair 306. The upstream-side reversing transporting section 400A, provided at the transporting-in section 210, includes, from an upstream side in the transfer direction Da2, an upstream-side first reversing roller pair 401, an upstream-side second reversing roller pair 402, an upstream-side third reversing roller pair 403, and an upstream-side fourth reversing roller pair 404 (situated closest to the reversing path Rb).

The midstream-side reversing transporting section 400B, provided at the reversing section 220, includes, from an upstream side in the reversing direction Db, a midstream-side first reversing roller pair 411 (situated closest to the transport-in path Ra), a midstream-side second reversing roller pair 412, and a midstream-side third reversing roller pair 413 (situated closest to the transport-out path Rc).

The downstream-side reversing transporting section 400C, provided at the transporting-out section 230, includes, from an upstream side in the transfer direction Dc1, a downstream-side first reversing roller pair 421 (situated closest to the reversing path Rb), a downstream-side second reversing roller pair 422, a downstream-side third reversing roller pair 423, and a downstream-side fourth reversing roller pair 424. The transporting-out transporting section 500, provided at the transporting-out section 230, includes, from an upstream side in the transport-out direction Dc2, a first transporting-out roller pair 501, a second transporting-out roller pair 502, a third transporting-out roller pair 503, a fourth transporting-out roller pair 504, a fifth transporting-out roller pair 505, and a sixth transporting-out roller pair 506 (situated closest to the fourth transport path R4).

In the transport-in path Ra, the upstream-side first reversing roller pair 401 to the upstream-side third reversing roller pair 403 of the upstream-side reversing transporting section 400A are disposed between the third transporting-in roller pair 303 and the fourth transporting-in roller pair 304 of the transporting-in transporting section 300. In the transport-out path Rc, the downstream-side second reversing roller pair 422 to the downstream-side fourth reversing roller pair 424 of the downstream-side reversing transporting section 400C are disposed between the third transporting-out roller pair 503 and the fourth transporting-out roller pair 504 of the transporting-out transporting section 500.

Here, in the exemplary embodiment, in transporting a sheet P from the third transport path R3 to the transport-in path Rc, a central position between the sheet first side end Ps1 and the sheet second side end Ps2 (both of which are shown in FIG. 3) of a sheet P that is being transported is aligned with a transporting-in-direction transport reference line La that is set linearly with respect to the third transport path R3 and the transport-in path Ra. In the transport-in path Ra, the rollers of the first transporting-in roller pair 301 to the sixth transporting-in roller pair 306 of the transporting-in transporting section 300 are disposed on respective sides of the transporting-in direction transport reference line La.

In the exemplary embodiment, in transporting a sheet P from the transport-in path Ra to the transport-out path Rc through the reversing path Rb, a central position between the sheet back end Pt and the sheet front end Pl of the sheet P that is being transported is aligned with a reversing-direction transport reference line Lb that is set linearly with respect to the reversing path Rb and the transport-out path Rc. In the transport-in path Ra, the rollers of the upstream-side first reversing roller pair 401 to the upstream-side fourth reversing roller pair 404 of the upstream-side reversing transporting section 400A are disposed on respective sides of the reversing-direction transport reference line Lb. Further, in the reversing path Rb, the rollers of the midstream-side first reversing roller pair 411 to the midstream-side third reversing roller pair 413 of the midstream-side reversing transporting section 400B are also disposed on respective sides of the reversing-direction transport reference line Lb. Further, in the transport-out path Rc, the rollers of the downstream-side first reversing roller pair 421 to the downstream-side fourth reversing roller pair 424 of the downstream-side reversing transporting section 400C are also disposed on respective sides of the reversing-direction transport reference line Lb.

Further, in the exemplary embodiment, in transporting a sheet P from the transport-out path Rc to the fourth transport path R4, a central position between the sheet first side end Ps1, and the sheet second side end Ps2 (both of which are shown in FIG. 2) of the sheet P that is being transported is aligned with a transporting-out-direction transport reference line Lc that is set linearly with respect to the fourth transport path R4 and the transport-out path Rc. In the transport-out path Rc, the first transporting-out roller pair 501 to the sixth transporting-out roller pair 506 of the transporting-out transporting section 500 are disposed on respective sides of the transporting-out-direction transport reference line Lc.

Figure 10A:
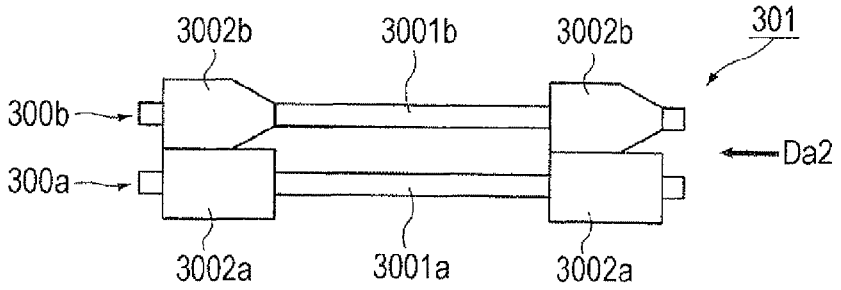
FIGS. 10A to 10E each illustrate the structure of a pair of transport rollers provided at each transporting section of the sheet reversing device.
Figure 10B:
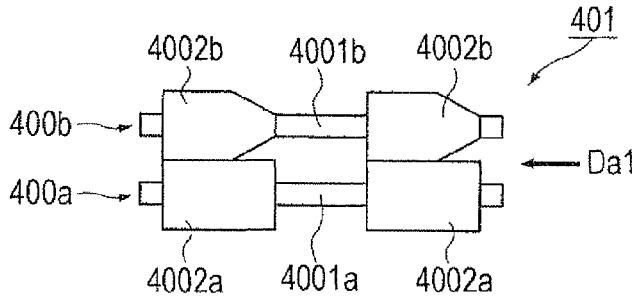
Figure 10C:
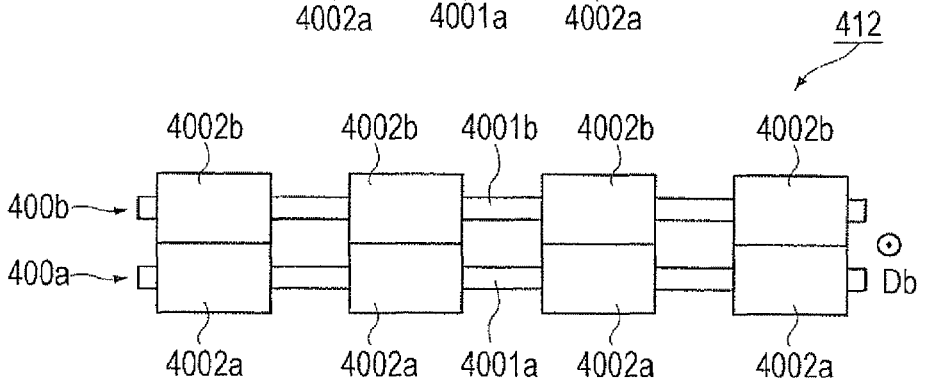
Figure 10D:
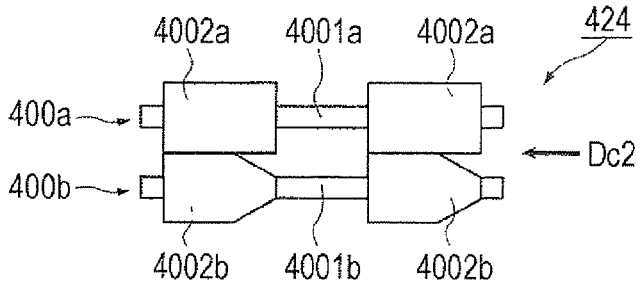
Figure 10E:
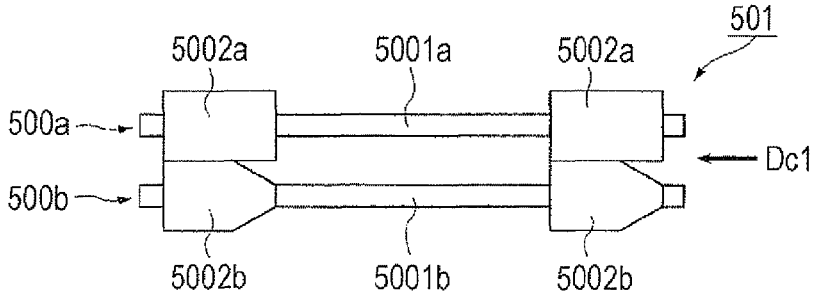

FIGS. 10A to 10E each illustrate the structure of a pair of transport rollers provided at each transporting section of the sheet reversing device 100. Here, FIG. 10A shows an exemplary structure of the first transporting-in roller pair 301 in the transporting-in transporting section 300 provided at the transporting-in section 210. FIG. 10B shows an exemplary structure of the upstream-side first reversing roller pair 401 in the upstream-side reversing transporting section 400A provided at the transport-in section 210. Further, FIG. 10C is an exemplary structure of the midstream-side second reversing roller pair 412 in the midstream-side reversing transporting section 400B provided at the reversing section 220. Still further, FIG. 10D shows an exemplary structure of the downstream-side fourth reversing roller pair 424 in the downstream-side reversing transporting section 400C provided at the transporting-out section 230. Still further, FIG. 10E shows an exemplary structure of the first transporting-out roller pair 501 in the transporting-out transporting section 500 provided at the transporting-out section 230.

As shown in FIG. 10A, the first transporting-in roller pair 301 of the transporting-in transporting section 300 includes a transporting-in driving roller 300*a* and a transporting-in driven roller 300*b*. The transporting-in driving roller 300*a* receives outside driving force. The transporting-in driven roller 300*b* is disposed so as to oppose the transporting-in driving roller 300*a*, and rotates as the transporting-in driving roller 300*a* rotates. The second transporting-in roller pair 302 to the sixth transporting-in roller pair 306 of the transporting-in transporting section 300 also each include a transporting-in driving roller 300*a* and a transporting-in driven roller 300*b*. In the exemplary embodiment, each transporting-in driving roller 300*a* of the first transporting-in roller pair 301 to the sixth transporting-in roller pair 306 is mounted to the first transporting-in guiding plate 211 (see FIG. 3), serving as a fixed side in the transporting-in section 210. Each transporting-in driven roller 300*b* of the first transporting-in roller pair 301 to the sixth transporting-in roller pair 306 is mounted to the second transporting-in guiding plate 212 (see FIG. 3), serving as a movable side (openable-closable side) in the transporting-in section 210 (see FIG. 3).

The first transporting-in roller pair 301 to the sixth transporting-in roller pair 306 function as a pair of rotating members, with each transporting-in driving roller 300*a* functioning as a driving rotating member and each transporting-in driven roller 300*b* functioning as a driven rotating member. In the first transporting-in roller pair 301 to the sixth transporting-in roller pair 306, each transporting-in driving roller 300*a* functions as an input-side driving rotating member, and each transporting-in driven roller 300*b* functions as an input-side driven rotating member.

Here, each transporting-in driving roller 300*a* includes a shaft 3001*a*, formed of metal and extending along the transfer direction Da2 in the transport-in path Ra (see FIG. 9), and two rubber rollers 3002*a*, mounted to the shaft 3001*a*. In each transporting-in driving roller 300*a*, each rubber roller 3002*a* has a columnar shape.

Each transporting-in driven roller 300*b* includes a shaft 3001*b* and two resin rollers 3002*b*. Each shaft 3001*b* is formed of metal and extends along the transfer direction Da2 in the transport-in path Ra (see FIG. 9). The resin rollers 3002*b* are mounted to positions of the shaft 3001*b* that are opposite to the respective rubber rollers 3002*a* provided at the transporting-in driving roller 300*a*. In each transporting-in driven roller 300*b*, one end side of each resin roller 3002*b*, serving as a downstream side in the transfer direction Da2, has a columnar shape, whereas the other end side of each resin roller 3002*b*, serving as an upstream side in the transfer direction Da2, is tapered (has a tapered portion).

As shown in FIG. 10B, the upstream-side first reversing roller pair 401 of the upstream-side reversing transporting section 400A includes a reversing driving roller 400*a* and a reversing driven roller 400*b*. The reversing driving roller 400*a* rotates by receiving outside driving force. The reversing driven roller 400*b* is disposed so as to oppose the reversing driving roller 400*a*, and rotates as the reversing driving roller 400*a* rotates. The upstream-side second reversing roller pair 402 to the upstream-side fourth reversing roller pair 404 of the upstream-side reversing transporting section 400A also each include a reversing driving roller 400*a* and a reversing driven roller 400*b*. In the exemplary embodiment, the reversing driving rollers 400*a* of the upstream-side first reversing roller pair 401 to the upstream-side fourth reversing roller pair 404 are mounted to the first transporting-in guiding plate 211 (see FIG. 2), serving as the fixed side in the transporting-in section 210. The reversing driven rollers 400*b* of the upstream-side first reversing roller pair 401 to the upstream-side fourth reversing roller pair 404 are mounted to the second transporting-in guiding plate 212 (see FIG. 2), serving as the movable side (that is, the openable-and-closable side) in the transporting-in section 210 (see FIG. 2).

The upstream-side first reversing roller pair 401 to the upstream-side fourth reversing roller pair 404 function as a pair of rotating members, with each reversing driving roller 400*a* functioning as a driving rotating member and each reversing driven roller 400*b* functioning as a driven rotating member. In each of the upstream-side first reversing roller pair 401 to the upstream-side fourth roller pair 404, the reversing driving roller 400*a* functions as an output-side driving rotating member, and each reversing driven roller 400*b* functions as an output-side driven rotating member.

Here, each reversing driving roller 400*a* of the upstream-side reversing transporting section 400A includes a shaft 4001*a*, formed of metal and extending along the transporting-in direction Da1 in the transport-in path Ra (see FIG. 9), and two rubber rollers 4002*a*, mounted to the shaft 4001*a*. In each reversing driving roller 400*a* of the upstream-side reversing transporting section 400A, each rubber roller 4002*a* has a columnar shape.

Each reversing driven roller 400*b* of the upstream-side reversing transporting section 400A includes a shaft 4001*b* and two resin rollers 4002*b*. Each shaft 4001*b* is formed of metal and extends along the transporting-in direction Da1 in the transport-in path Ra (see FIG. 9). The resin rollers 4002*b* are mounted to positions of the corresponding shaft 4001*b* that are opposite to the respective rubber rollers 4002*a* provided at the corresponding reversing driving roller 400*a*. In each reversing driven roller 400*b* of the upstream-side reversing transporting section 400A, one end side of each resin roller 4002*b*, serving as a downstream side in the transporting-in direction Da1, has a columnar shape, whereas the other end side of each resin roller 4002*b*, serving as an upstream side in the transporting-in direction Da1, is tapered (has a tapered portion).

In the reversing driving roller 400*a* of the upstream-side fourth reversing roller pair 404, four rubber rollers 4002*a* are mounted to one shaft 4001*a*. In the reversing driven roller 400*b* of the upstream-side fourth reversing roller pair 404, four rubber rollers 4002*b* are mounted to one shaft 4001*b*.

As shown in FIG. 10C, the midstream-side second reversing roller pair 412 of the midstream-side reversing transporting section 400B includes a reversing driving roller 400*a* and a reversing driven roller 400*b*. The reversing driving roller 400*a* rotates by receiving outside driving force. The reversing driven roller 400*b* is disposed so as to oppose the reversing driving roller 400*a*, and rotates as the reversing driving roller 400*a* rotates. The midstream-side first reversing roller pair 411 and the midstream-side third reversing roller pair 413 of the midstream-side reversing transporting section 400B also each include a reversing driving roller 400*a* and a reversing driven roller 400*b*. In the exemplary embodiment, the reversing driving rollers 400*a* of the midstream-side first reversing roller pair 411 to the midstream-side third reversing roller pair 413 are mounted to the first reversing guiding plate 211 (see FIG. 2), serving as a fixed side in the reversing section 220 (see FIG. 2). The reversing driven rollers 400*b* of the midstream-side first reversing roller pair 411 to the midstream-side third reversing roller pair 413 are mounted to the second reversing guiding plate 222 (see FIG. 2), serving as a movable side (that is, an openable-and-closable side) in the reversing section 210 (see FIG. 2).

Here, each reversing driving roller 400*a* of the midstream-side reversing transporting section 400B includes a shaft 4001*a* and four rubber rollers 4002*a*. Each shaft 4001*a* is formed of metal, crosses the reversing direction Db in the reversing path Rb (see FIG. 9), and extends along the transporting-in direction Da1 and the transporting-out direction Dc2. The four rubber rollers 4002*a* of each reversing driving roller 400*a* are mounted to the corresponding shaft 4001*a*. In each reversing driving roller 400*a* of the midstream-side reversing transporting section 400B, each rubber roller 4002*a* has a columnar shape.

Each reversing driven roller 400*b* of the midstream-side reversing transporting section 400B includes a shaft 4001*b* and four resin rollers 4002*b*. Each shaft 4001*b* is formed of metal, crosses the reversing direction Db in the reversing path Rb, and extends along the transporting-in direction Da1 and the transporting-out direction Dc2. The resin rollers 4002*b* are mounted to positions of the corresponding shaft 4001*b* that are opposite to the respective rubber rollers 4002*a* provided at the corresponding reversing driving roller 400*a*. In each reversing driven roller 400*b* of the midstream-side reversing transporting section 400B, each resin roller 4002*b* has a columnar shape.

As shown in FIG. 10D, the downstream-side fourth reversing roller pair 424 of the downstream-side reversing transporting section 400C includes a reversing driving roller 400*a* and a reversing driven roller 400*b*. The reversing driving roller 400*a* rotates by receiving outside driving force. The reversing driven roller 400*b* is disposed so as to oppose the reversing driving roller 400*a*, and rotates as the reversing driving roller 400*a* rotates. The downstream-side first reversing roller pair 421 to the downstream-side third reversing roller pair 413 of the downstream-side reversing transporting section 400C also each include a reversing driving roller 400*a* and a reversing driven roller 400*b*. In the exemplary embodiment, each reversing driving rollers 400*a* of the downstream-side first reversing roller pair 421 to the downstream-side fourth reversing roller pair 424 are mounted to the first transporting-out guiding plate 231 (see FIG. 3), serving as a fixed side in the transporting-out section 230 (see FIG. 3). The reversing driven rollers 400*b* of the downstream-side first reversing roller pair 421 to the downstream-side fourth reversing roller pair 424 are mounted to the second transporting-out guiding plate 232 (see FIG. 3), serving as a movable side (that is, an openable-and-closable side) in the transporting-out section 230 (see FIG. 3).

The downstream-side first reversing roller pair 421 to the downstream-side fourth reversing roller pair 424 function as a pair of rotating members, with each reversing driving roller 400*a* functioning as a driving rotating member and each reversing driven roller 400*b* functioning as a driven rotating member. In each of the downstream-side first reversing roller pair 421 to the downstream-side fourth reversing roller pair 424, the reversing driving roller 400*a* functions as an input-side driving rotating member, and the reversing driven roller 400*b* functions as an input-side driven rotating member.

Here, each reversing driving roller 400*a* of the downstream-side reversing transporting section 400C includes a shaft 4001*a*, formed of metal and extending along the transporting-out direction Dc2 in the transporting-out path Rc (see FIG. 9), and two rubber rollers 4002*a*, mounted to the shaft 4001*a*. In each reversing driving roller 400*a* of the downstream-side reversing transporting section 400C, each rubber roller 4002*a* has a columnar shape.

Each reversing driven roller 400*b* of the downstream-side reversing transporting section 400C includes a shaft 4001*b* and two resin rollers 4002*b*. Each shaft 4001*b* is formed of metal, and extends along the transporting-out direction Dc2 in the transport-out path Rc (see FIG. 9). The resin rollers 4002*b* are mounted to positions of the corresponding shaft 4001*b* that are opposite to the respective rubber rollers 4002*a* provided at the corresponding reversing driving roller 400*a*. In each reversing driven roller 400*b* of the downstream-side reversing transporting section 400C, one end side of each resin roller 4002*b*, serving as a downstream side in the transporting-out direction Da2, has a columnar shape, whereas the other end side of each resin roller 4002*b*, serving as an upstream side in the transporting-out direction Da2, is tapered (has a tapered portion).

In the reversing driving roller 400*a* of the downstream-side first reversing roller pair 421, four rubber rollers 4002*a* are mounted to one shaft 4001*a*. In the reversing driven roller 400*b* of the downstream-side first reversing roller pair 421, four rubber rollers 4002*b* are mounted to one shaft 4001*b*.

As shown in FIG. 10E, the first transporting-out roller pair 501 of the transporting-out transporting section 500 includes a transporting-out driving roller 500*a* and a transporting-out driven roller 500*b*. The transporting-out driving roller 500*a* rotates by receiving outside driving force. The transporting-out driven roller 500*b* is disposed so as to oppose the transporting-out driving roller 500*a*, and rotates as the transporting-out driving roller 500*a* rotates. The second transporting-out roller pair 502 to the sixth transporting-out roller pair 506 of the transporting-out transporting section 500 also each include a transporting-out driving roller 500*a* and a transporting-out driven roller 500*b*. In the exemplary embodiment, the transporting-out driving rollers 500*a* of the first transporting-out roller pair 501 to the sixth transporting-out roller pair 506 are mounted to the first transporting-out guiding plate 231 (see FIG. 2), serving as a fixed side in the transporting-out section 230 (see FIG. 2). The transporting-out driven rollers 500*b* of the first transporting-out roller pair 501 to the sixth reversing transporting-out roller pair 506 are mounted to the second transporting-out guiding plate 232 (see FIG. 2), serving as the movable side (that is, the openable-and-closable side) in the transporting-out section 230 (see FIG. 2).

The first transporting-out roller pair 501 to the sixth transporting roller pair 506 function as a pair of rotating members, with each transporting-out driving roller 500*a* functioning as a driving rotating member and each transporting-out driven roller 500*b* functioning as a driven rotating member. In each of the first transporting-out roller pair 501 to the sixth transporting-out roller pair 506, the transporting-out driving roller 500*a* functions as an output-side driving rotating member, and the transporting-out driven roller 500*b* functions as an output-side driven rotating member.

Here, each transporting-out driving roller 500*a* includes a shaft 5001*a*, formed of metal and extending along the transfer direction Dc1 in the transport-out path Rc (see FIG. 9), and two rubber rollers 5002*a*, mounted to the shaft 5001*a*. In each transporting-out driving roller 500*a*, each rubber roller 5002*a* has a columnar shape.

Each transporting-out driven roller 500*b* includes a shaft 5001*b* and two resin rollers 5002*b*. Each shaft 5001*b* is formed of metal, and extends along the transfer direction Da1 in the transport-out path Rc (see FIG. 9). The resin rollers 5002*b* are mounted to positions of the corresponding shaft 5001*b* that are opposite to the respective rubber rollers 5002*a* provided at the corresponding transporting-out driving roller 500*a*. In each resin roller 5002*b* of the transporting-out driven roller 500*b*, one end side of each resin roller 5002*b*, serving as a downstream side in the transfer direction Dc1, has a columnar shape, whereas the other end side of each resin roller 5002*b*, serving as an upstream side in the transfer direction Da1, is tapered (has a tapered portion).

Figure 11A:
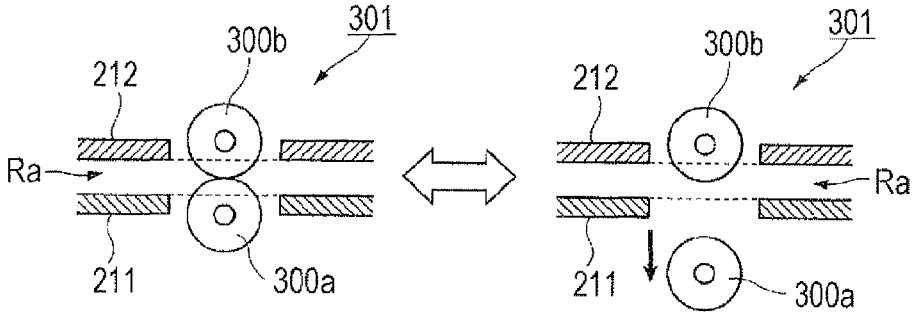
FIGS. 11A to 11E each illustrate the relationship between the pair of transport rollers and the corresponding transport path in the sheet reversing device.
Figure 11B:
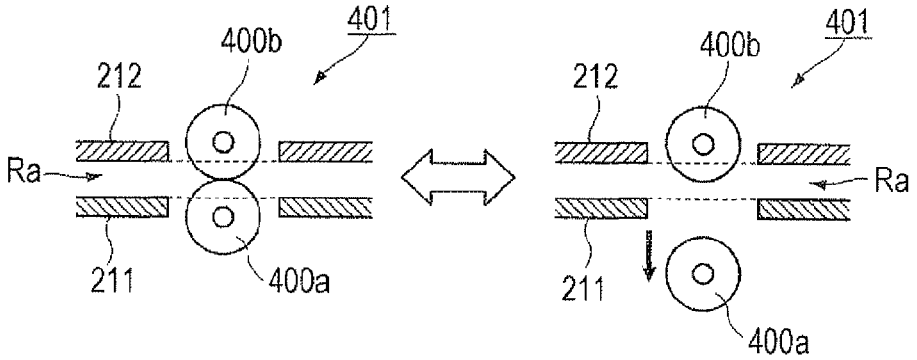
Figure 11C:
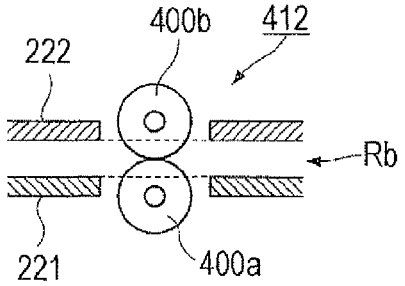
Figure 11D:
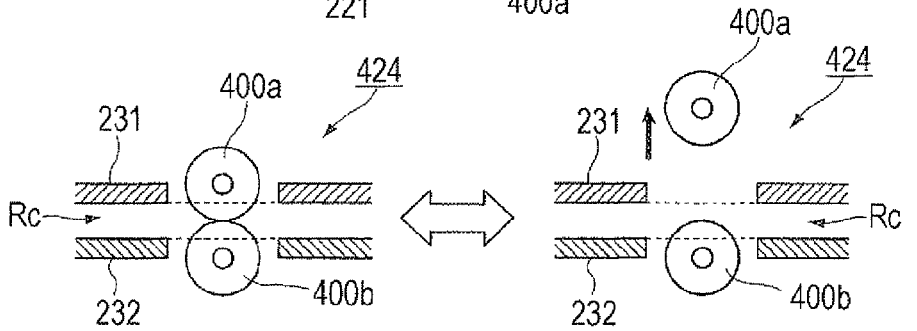
Figure 11E:
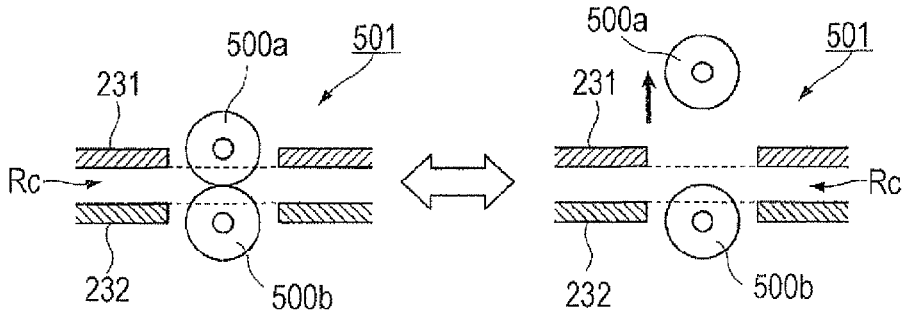

FIGS. 11A to 11E each illustrate the relationship between the pair of transport rollers and the corresponding transport path in the sheet reversing device 100 according to the exemplary embodiment. FIGS. 11A to 11E correspond to FIGS. 10A to 10E. That is, FIG. 11A shows the relationship between the transport-in path Ra and the first transporting-in roller pair 301 in the transporting-in section 210. In addition, FIG. 11B shows the relationship between the transport-in path Ra and the upstream-side first reversing roller pair 401 in the transporting-in section 210. Further, FIG. 11C shows the relationship between the reversing path Rb and the midstream-side second reversing roller pair 412 in the reversing section 220. Still further, FIG. 11D shows the relationship between the transport-out path Rc and the downstream-side fourth reversing roller pair 424 in the transporting-out section 230. Still further, FIG. 11E shows the relationship between the transport-out path Rc and the first transporting-out roller pair 501 in the transporting-out section 230.

As shown in FIG. 11A, the transporting-in driving roller 300*a* and the transporting-in driven roller 300*b* of the first transporting-in roller pair 301 are contactably and separably formed. When the rollers 300*a* and 300*b* of the first transporting-in roller pair 301 contact each other, the transporting-in driving roller 300*a* and the transporting-in driven roller 300*b* are in a state in which they are in the transport-in path Ra. In contrast, when the transporting-in driving roller 300*a* and the transporting-in driven roller 300*b* of the first transporting-in roller pair 301 are to be separated from each other, moving the transporting-in driving roller 300*a* away from the transporting-in driven roller 300*b* causes the transporting-in driven roller 300*b* to be kept in the transport-in path Ra, and the transporting-in driving roller 300*a* to retreat from the transport-in path Ra. The rollers of the second transporting-in roller pair 302 to the sixth transporting-in roller pair 306 that constitute the transporting-in transporting section 300 along with the first transporting-in roller pair 301 also contact and separate from each other as with the rollers of the first transporting-in roller pair 301.

As shown in FIG. 11B, the reversing driving roller 400*a* and the reversing driven roller 400*b* of the upstream-side first reversing roller pair 401 are contactably and separably formed. When the reversing driving roller 400*a* and the reversing driven roller 400*b* of the upstream-side first reversing roller pair 401 contact each other, the reversing driving roller 400*a* and the reversing driven roller 400*b* are in a state in which they are in the transport-in path Ra. In contrast, when the reversing driving roller 400*a* and the reversing driven roller 400*b* of the upstream-side reversing roller pair 401 are to be separated from each other, moving the reversing driving roller 400*a* away from the reversing driven roller 400*b* causes the reversing driven roller 400*b* to be kept in the transport-in path Ra, and the reversing driving roller 400*a* to retreat from the transport-in path Ra. The rollers of the upstream-side second reversing roller pair 402 to the upstream-side fourth reversing roller pair 404 that constitute the upstream-side reversing transporting section 400A along with the upstream-side first reversing roller pair 401 also contact and separate from each other as with the rollers of the upstream-side first reversing roller pair 401.

As shown in FIG. 110, the reversing driving roller 400*a* and the reversing driven roller 400*b* of the midstream-side second reversing roller pair 412 are formed so that they normally contact each other. At this time, both of the reversing driving roller 400*a* and the reversing driven roller 400*b* are in a state in which they are in the reversing path Rb. The midstream-side first reversing roller pair 411 and the midstream-side third reversing roller pair 413 that constitute the midstream-side reversing transporting section 400B along with the midstream-side second reversing roller pair 412 are also formed so that their rollers normally contact each other as with the rollers of the midstream-side second reversing roller pair 412.

As shown in FIG. 11D, the reversing driving roller 400*a* and the reversing driven roller 400*b* of the downstream-side fourth reversing roller pair 424 are contactably and separably formed. When the reversing driving roller 400*a* and the reversing driven roller 400*b* of the downstream-side fourth reversing roller pair 424 contact each other, the reversing driving roller 400*a* and the reversing driven roller 400*b* are in a state in which they are in the transport-out path Rc. In contrast, when the reversing driving roller 400*a* and the reversing driven roller 400*b* of the downstream-side fourth reversing roller pair 424 are to be separated from each other, moving the reversing driving roller 400*a* away from the reversing driven roller 400*b* causes the reversing driven roller 400*b* to be kept in the transport-out path Rc, and the reversing driving roller 400*a* to retreat from the transport-out path Rc. The rollers of the downstream-side first reversing roller pair 421 to the downstream-side third reversing roller pair 423 that constitute the downstream-side reversing transporting section 400C along with the downstream-side fourth reversing roller pair 424 also contact and separate from each other as with the rollers of the downstream-side fourth reversing roller pair 424.

As shown in FIG. 11E, the transporting-out driving roller 500*a* and the transporting-out driven roller 500*b* of the first transporting-out roller pair 501 are contactably and separably formed. When the transporting-out driving roller 500*a* and the transporting-out driven roller 500*b* of the first transporting-out roller pair 501 contact each other, the transporting-out driving roller 500*a* and the transporting-out driven roller 500*b* are in a state in which they are in the transport-out path Rc. In contrast, when the transporting-out driving roller 500*a* and the transporting-out driven roller 500*b* of the first transporting-out roller pair 501 are to be separated from each other, moving the transporting-out driving roller 500*a* away from the transporting-out driven roller 500*b* causes the transporting-out driven roller 500*b* to be kept in the transport-out path Rc, and the transporting-out driving roller 500*a* to retreat from the transport-out path Rc. The rollers of the second transporting-out roller pair 502 to the sixth transporting-out roller pair 506 that constitute the transporting-out transporting section 500 along with the first transporting-out roller pair 501 also contact and separate from each other as with the rollers of the first transport-out roller pair 501.

Figure 12A:
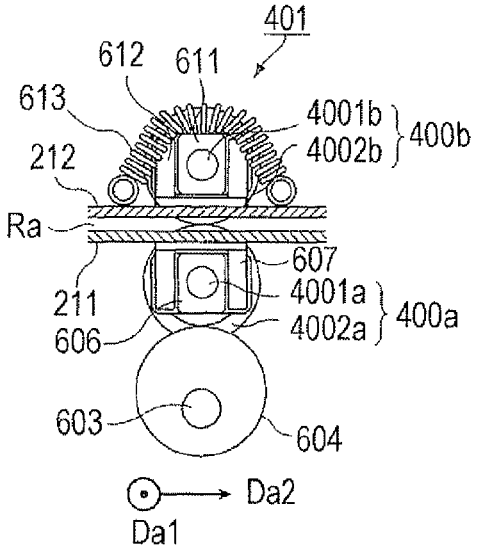
FIGS. 12A to 12D each illustrate an exemplary structure of an advancing/retreating mechanism and a rotating mechanism of a pair of upstream-side first reversing rollers.
Figure 12B:
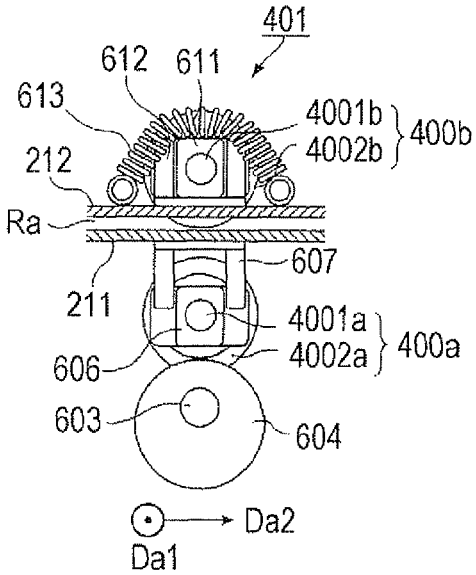
Figure 12C:
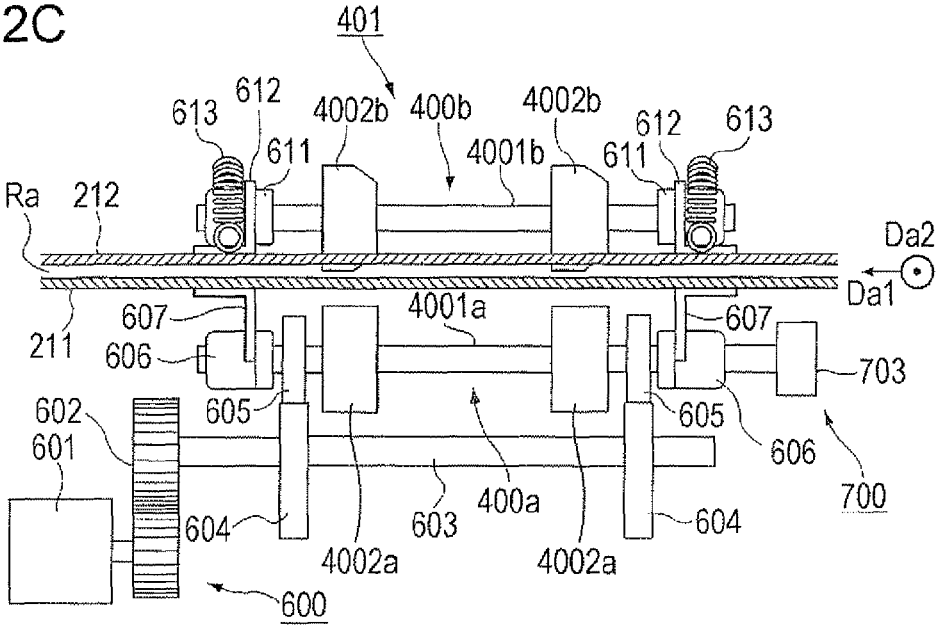
Figure 12D:
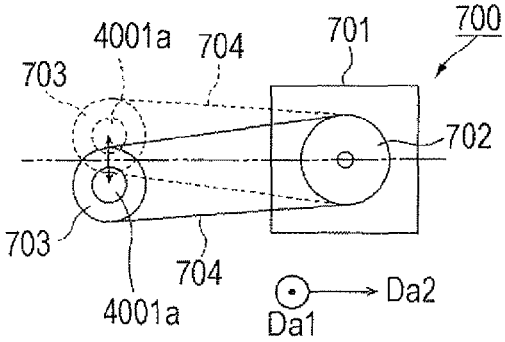

FIGS. 12A to 12D each illustrate an exemplary structure of an advancing/retreating mechanism 600 and a rotating mechanism 700. The advancing/retreating mechanism 600 causes one of the rollers of the upstream-side first reversing roller pair 401 to advance and retreat. The rotating mechanism 700 rotates the upstream-side first reversing roller pair 401. Here, FIG. 12A shows the upstream-side first reversing roller pair 401, whose rollers contact each other, and the advancing/retreating mechanism 600 as viewed from the downstream side in the transport-in direction Da1. FIG. 12B shows the upstream-side first reversing roller pair 401, whose rollers are separated from each other, and the advancing/retreating mechanism 600 as viewed from the downstream side in the transporting-in direction Da1. FIG. 12C shows the upstream-side first reversing roller pair 401, whose rollers are separated from each other, the advancing/retreating mechanism 600, and the rotating mechanism 700 as viewed from a downstream side in the transfer direction Da2. FIG. 12D shows the rotating mechanism 700 as viewed from the downstream side in the transporting-in direction Da1.

The advancing/retreating mechanism 600 according to the exemplary embodiment includes an advancing/retreating motor 601, a gear train 602, a driving-side cam shaft 603, and driving-side cams 604. The advancing/retreating motor 601 causes the reversing driving roller 400*a* in the upstream-side first reversing roller pair 401 to advance towards and retreat from the reversing driven roller 400*b*. The gear train 602 includes gears that are mounted to a rotary shaft of the advancing/retreating motor 601. The driving-side cam shaft 603 is secured and mounted to one of the gears of the gear train 602. The driving-side cams 604 are mounted to two locations of the driving-side cam shaft 603 in an axial direction. The advancing/retreating mechanism 600 also includes ball bearings 605, driving-side bearings 606, and driving-side bearing guides 607. The ball bearings 605 are mounted to positions of the shaft 4001*a* of the reversing driving roller 400*a* opposing the two driving-side cams 604 provided at the driving-side cam shaft 603. The driving-side bearings 600 are mounted to respective ends of the shaft 4001*a* of the reversing driving roller 400*a*, and rotatably support the reversing driving roller 400*a*. In correspondence with the two driving-side bearings 606, the driving-side bearing guides 607 are secured and mounted to a surface of the first transporting-in guiding plate 211 at a side opposite to a surface of the first transporting-in guiding plate 211 where the transport-in path Ra is formed. The driving-side bearing guides 607 support the reversing driving roller 400*a* using the driving-side bearings 606 so that the reversing driving roller 400*a* is movable towards and away from the transport-in path Ra. The advancing/retreating mechanism 600 further includes driven-side bearings 611, driven-side bearing guides 612, and springs 613. The driven-side bearings 611 are mounted to respective ends of the shaft 4001*b* of the reversing driven roller 400*b* in the upstream-side first reversing roller pair 401, and rotatably support the reversing driven roller 400*b*. In correspondence with the two driven-side bearings 611, the driven-side bearing guides 612 are secured and mounted to a surface of the second transporting-in guiding plate 212 at a side opposite to a surface of the second transporting-in guiding plate 212 where the transport-in path Ra is formed. The driven-side bearing guides 612 support the reversing driven roller 400*b* so that the reversing driven roller 400*b* is movable towards and away from the transport-in path Ra. Both ends of the springs 613 are secured and mounted to the surface of the second transporting-in guiding plate 212 at the side opposite to the surface of the second transporting-in guiding plate 212 where the transport-in path Ra is formed. A central portion of each spring 613 is mounted to a portion of the corresponding driven-side bearing 611 that is disposed outwardly of a portion of the driven-side bearing 611 that is supported by the corresponding driven-side bearing guide 612.

The rotating mechanism 700 according to the exemplary embodiment includes a rotating motor 701, a motor-side pulley 702, a roller-side pulley 703, and a timing belt 704. The rotating motor 701 is used for rotating the reversing driving roller 400*a* in the upstream-side first reversing roller pair 401. The motor-side pulley 702 is mounted to a rotary shaft of the rotating motor 701. The roller-side pulley 703 is secured and mounted to an end side of the shaft 4001*a* in the reversing driving roller 400*a*. The timing belt 704 is an endless belt, and is placed on the motor-side pulley 702 and the roller-side pulley 703.

The operation for causing the separated rollers of the upstream-side first reversing roller pair 401 to contact each other (hereunder referred to as "contacting operation") will be described. In an initial state of the contacting operation, driving of the advancing/retreating motor 601 is stopped. The upstream-side first reversing roller pair 401 and the advancing/retreating mechanism 600 are positioned as shown in FIGS. 12B and 12C. In FIG. 12D, the rotating mechanism 700 is positioned as indicated by a solid line. In the initial state of the contacting operation, driving of the rotating motor 701 is stopped, and rotation of the reversing driving roller 400*a* and rotation of the reversing driven roller 400*b* of the upstream-side first reversing roller pair 401 are both stopped. At this time, each resin roller 4002*b* of the reversing driven roller 400*b* is in the transport-in path Ra, and is set at a position where it does not block the transport-in path Ra. In addition, each rubber roller 4002*a* of the reversing driving roller 400*a* is set at a position where it retreats from the transport-in path Ra.

As the contacting operation starts, the rotating motor 701 starts rotating. As the rotating motor 701 rotates, the motor-side pulley 702, the timing belt 704, and the roller-side pulley 703 cause rotation of the reversing driving roller 400*a* of the upstream-side first reversing roller pair 401 to start. Since, at this time, the reversing driving roller 400*a* and the reversing driven roller 400*b* are not in contact with each other, the rotation of the reversing driven roller 400*b* remains stopped.

Next, the advancing/retreating motor 601 starts rotating. As the advancing/retreating motor 601 rotates, rotation of each driving-side cam 604 starts through the gear train 602 and the driving-side cam shaft 603. The advancing/retreating motor 601 stops rotating when each driving-side cam 604 is partially rotated from the state shown in FIG. 12B and returns to the state shown in FIG. 12A. Such rotation of each driving-side cam 604 causes each ball bearing 605 to be pushed upward towards the transport-in path Ra by a cam surface of each driving-side cam 604. As a result, the reversing driving roller 400*a* including the shaft 4001*a* to which each driving-side cam 604 is mounted approaches the reversing driven roller 400*b* opposing the reversing driving roller 400*a* with the transport-in path Ra being interposed therebetween. After the reversing driving roller 400*a* moves into the transport-in path Ra, the rubber rollers 4002*a* of the reversing driving roller 400*a* and the respective resin rollers 4002*b* of the reversing driven roller 400*b* contact each other in the transport-in path Ra. When a sheet P exists in the transport-in path Ra at this time, the reversing driving roller 400*a* and the reversing driven roller 400*b* contact each other through the sheet P.

When the reversing driving roller 400*a* comes into contact with the reversing driven roller 400*b*, the reversing driven roller 400*b* receives a force acting in a direction away from transport-in path Ra from the reversing driving roller 400*a*. As a result, the reversing driven roller 400*b* tries to move away from the transport path Ra. Here, in the exemplary embodiment, the driven-side bearings 611, mounted to the respective ends of the shaft 4001*b* of the reversing driven roller 400*b*, receive a force acting in a direction towards the transport-in path Ra through the springs 613, mounted to the second transporting-in guiding plate 212. Therefore, while a state in which the reversing driven roller 400*b* is supported at the second transporting-in guiding plate 212 by the driven-side bearings 611 and the driven-side bearing guides 612 is maintained, the reversing driven roller 400*b* is stationary at a position where a pushing force by the reversing driving roller 400*a* and a pushing force by the springs 613 balance.

When the reversing driving roller 400*a* comes into contact with the reversing driven roller 400*b*, the reversing driven roller 400*b* receives driving force from the reversing driving roller 400*a* and starts rotating. At this time, the position where the reversing driving roller 400*a* and the reversing driven roller 400*b* contact each other is situated at an inner side of the transport-in path Ra. When a separation state changes to a contact state, the roller-side pulley 703 moves with respect to the rotating motor 701 and the motor-side pulley 702 from the position indicated by the solid line in FIG. 12D to a position indicated by a broken line in FIG. 12D. At this time, the positional change between the motor-side pulley 702, mounted to the rotating motor 701, and the roller-side pulley 703, mounted to the reversing driving roller 400*a*, is absorbed by the timing belt 704, so that the rotational driving of the reversing driving roller 400*a* is continued regardless of the positional change.

Next, the operation for separating the rollers 400*a* and 400*b* of the upstream-side first reversing roller pair 401 that are in contact with each other (hereunder referred to as "separating operation") will be described. In an initial state of the separating operation, driving of the advancing/retreating motor 601 is stopped. The upstream-side first reversing roller pair 401 and the advancing/retreating mechanism 600 are positioned as shown in FIG. 12A. In FIG. 12D, the rotating mechanism 700 is positioned as indicated by the broken line. In the initial state of the separating operation, driving of the rotating motor 701 is continued, and the rotation of the reversing driving roller 400*a* and the rotation of the reversing driven roller 400*b* of the upstream-side first reversing roller pair 401 are both continued. At this time, each rubber roller 4002*a* of the reversing driving roller 400*a* and each resin roller 4002*b* of the reversing driven roller 400*b* are set at the positions where they are in the transport-in path Ra.

As the separating operation starts, the rotation of the rotating motor 701 is stopped. As the rotation of the rotating motor 701 is stopped, the rotations of the motor-side pulley 702, the timing belt 704, the roller-side pulley 703, and the reversing driving roller 400*a* are stopped. In addition, as the rotation of the reversing driving roller 400*a* is stopped, the rotation of the reversing driven roller 400*b* that contacts the reversing driving roller 400*a* is also stopped. When a sheet P exists in the transport-in path Ra, transportation of the sheet P nipped by the reversing driving roller 400*a* and the reversing driven roller 400*b* is also stopped.

Next, the advancing/retreating motor 601 starts rotating. As the advancing/retreating motor 601 rotates, rotation of each driving-side cam 604 starts through the gear train 602 and the driving-side can shaft 603. The advancing/retreating motor 601 stops rotating when each driving-side cam 604 is partially rotated from the state shown in FIG. 12A and returns to the state shown in FIG. 12B. Such rotation of each driving-side cam 604 causes each ball bearing 605 to be pushed downward away from the transport-in path Ra by the cam surface of each driving-side cam 604. As a result, the reversing driving roller 400*a* including the shaft 4001*a* to which each driving-side cam 604 is mounted moves away from the reversing driven roller 400*b* opposing the reversing driving roller 400*a* with the transport-in path Ra being interposed therebetween and contacting the reversing driving roller 400*a*. In the transport-in path Ra, each rubber roller 4002*a* of the reversing driving roller 400*a* separates from its corresponding resin roller 4002*b* of the reversing driven roller 400*b*, and retreats from the transport-in path Ra.

When the reversing driving roller 400*a* separates from the reversing driven roller 400*b*, the reversing driven roller 400*b* no longer receives the force acting in the direction away from the transport-in path Ra from the reversing driving roller 400*a*, whereas it continues receiving the force acting in the direction towards the transport-in path Ra through the springs 613 and the driven-side bearing guides 612. As a result, the reversing driven roller 400*b* tries to move towards the transport-input path Ra. Here, in the exemplary embodiment, the movement of the driven-side bearings 611, mounted to the respective ends of the shaft 4001*b* of the reversing driven roller 400*b*, towards the transport-in path Ra is regulated by the driven-side bearing guides 612, provided in correspondence with the driven-side bearings 611. Therefore, while the state in which the reversing driven roller 400*b* is supported at the second transporting-in guiding plate 212 by the driven-side bearings 611 and the driven-side bearing guides 612 is maintained, the reversing driven roller 400*b* is stationary at a position where the reversing driven roller 400*b* abuts an end portion of each driven-side bearing guide 612 at a transport-in-path-Ra side by a pushing force by the springs 613. At this time, while a state in which the resin rollers 4002*b* of the reversing driven roller 400*b* are in the transport-in path Ra is maintained, the resin rollers 4002*b* are positioned where they do not block the transport-in path Ra.

Although, here, the upstream-side reversing roller pair 401 is described as an example, the upstream-side second reversing roller pair 402 to the upstream-side fourth reversing roller pair 404 constituting the upstream-side reversing transporting section 400A along with the upstream-side first reversing roller pair 401 are each also provided with an advancing/retreating mechanism 600 and a rotating mechanism 700. In addition, the first transporting-in roller pair 301 to the sixth transporting-in roller pair 306 of the transporting-in transporting section 300, the downstream-side first reversing roller pair 421 to the downstream-side fourth reversing roller pair 424 of the downstream-side reversing transporting section 400C, and the first transporting-out roller pair 501 to the sixth transporting-out roller pair 506 of the transporting-out transporting section 500 are each also provided an advancing/retreating mechanism 600 and a rotating mechanism 700. Although the midstream-side first reversing roller pair 411 to the midstream-side third reversing roller pair 413 of the midstream-side reversing transporting section 400B are each also provided with a rotating mechanism 700 for rotationally driving the corresponding midstream-side reversing roller pair, they are not provided with an advancing/retreating mechanism 600 for driving the corresponding reversing roller pair for causing its roller to advance or retreat.

In the exemplary embodiment, the driven-side bearings 611, the driven-side bearing guides 612, and the springs 613, provided in correspondence with the transporting-in transporting section 300, the upstream-side reversing transporting section 400A, the downstream-side reversing transporting section 400C, and the transporting-out transporting section 500 function as regulating sections. At the transporting-in section 210, the driven-side bearings 611, the driven-side bearing guides 612, and the springs 613 of the transporting-in transporting section 300 function as input-side regulating sections, whereas the driven-side bearings 611, the driven-side bearing guides 612, and the springs 613 of the upstream-side reversing transporting section 400A function as output-side regulating sections. At the transporting-out section 230, the driven-side bearings 611, the driven-side bearing guides 612, and the springs 613 of the downstream-side reversing transporting section 400C function as input-side regulating sections, whereas the driven-side bearings 611, the driven-side bearing guides 612, and the springs 613 of the transporting-out transporting section 500 function as output-side regulating sections.

Figure 13:
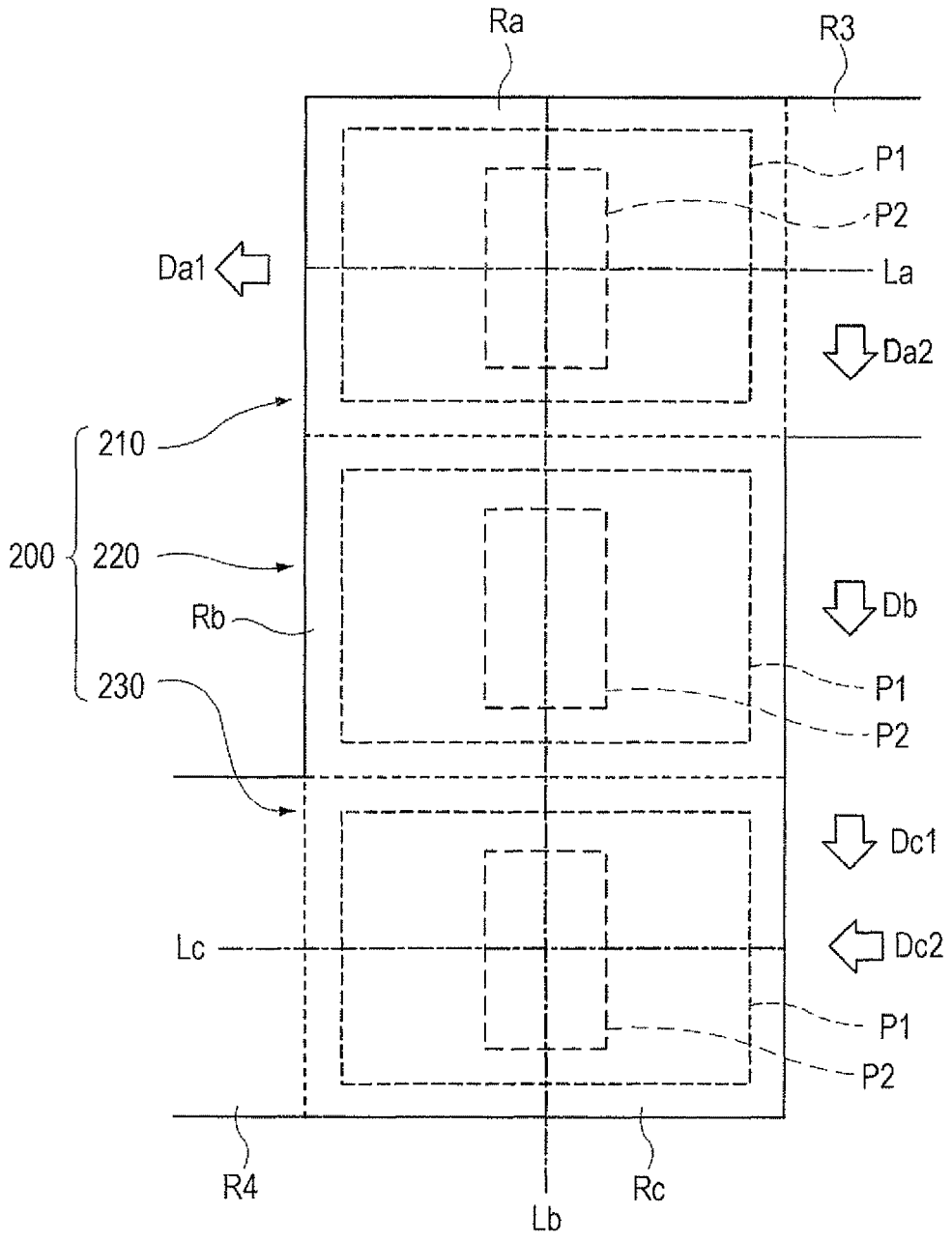
FIG. 13 illustrates the behavior of a sheet that passes through the sheet reversing device.

The reversing and transporting of sheets P by the sheet reversing device 100 according to the exemplary embodiment will be described. FIG. 13 illustrates the behavior of the sheets P that passes through the sheet reversing device 100. In FIG. 13, a first sheet P1 and a second sheet P2 having different sizes are exemplified as the sheets P. FIG. 13 shows a case in which the first sheet P1 is a JISA3 size short end feed (SEF) sheet, and a case in which the second sheet P2 is a JISA4 size long end feed (LEF) sheet.

In an initial state, the first transporting-in roller pair 301 to the sixth transporting-in roller pair 306 of the transporting-in transporting section 300 are each set in a separated state and a rotation stoppage state. In addition, the upstream-side first reversing roller pair 401 to the upstream-side fourth reversing roller pair 404 of the upstream-side reversing transporting section 400A are each set in a separated state and a rotation stoppage state. Further, the midstream-side first reversing roller pair 411 to the midstream-side third reversing roller pair 413 of the midstream-side reversing transporting section 400B are each set in a rotation stoppage state. Still further, the downstream-side first reversing roller pair 421 to the downstream-side fourth reversing roller pair 424 of the downstream-side reversing transporting section 400C are each set in a separated state and a rotation stoppage state. Still further, the first transporting-out roller pair 501 to the sixth transporting-out roller pair 506 of the transporting-out transporting section 500 are each set in a separated state and a rotation stoppage state.

For example, when images are to be formed on both surfaces of a sheet P, the sheet P having an image formed on a first surface thereof by the image forming units 10 and the fixing device 50 is transported to the third transport path R3 through the second transport path R2. At the third transport path R3, the sheet P is transported with its front end Pl being a leading end and a sheet surface Pf facing upward. At this time, on the basis of the length from a first side end Ps1 to a second side end Ps2 (hereunder referred to as "sheet width") of the sheet P input using, for example, UI 90, the controller 80 transports the sheet P so that a central position in the sheet width of the sheet P overlaps the transporting-in direction transport reference line La.

Next, at the third transport path R3, on the basis of a result of detection of a passage of the front end Pl of the sheet P by the sheet detecting sensor 60, the controller 80 causes the transporting-in transporting section 300 to start rotating and to start a contacting operation. This causes the rollers of the transporting-in transporting section 300 to be set in a contact state and to start rotating at the transport-in path Ra.

Then, the sheet P is moved along the transporting-in direction Da1 from the inside of the third transport path R3 to the inside of the transporting-in path Ra. At this time, at the transport-in path Ra, the rollers of the transporting-in transporting section 300 are set in the contact state and rotate. In contrast, at this time, at the transport-in path Ra, the rollers of the upstream-side reversing transporting section 400A are set in a separated state and their rotation is stopped. Therefore, the sheet P that enters the transport-in path Ra from the third transport path R3 is moved along the transport-in direction Da1 with the front end Pl being the leading end and the sheet surface Pf facing upward while the sheet P is nipped by the transporting-in transporting section 300. Here, in the exemplary embodiment, the reversing driven rollers 400*b* of the upstream-side reversing transporting section 400A that are set in the separated state are kept in the transport-in path Ra (see FIG. 11B). However, since the resin rollers 4002*b* of each reversing driven roller 400*b* are tapered (see FIG. 10B), each reversing driven roller 400*b* does not tend to interfere with the transportation of the sheet P in the transporting-in direction Da1.

Then, the sheet P stops in the transport-in path Ra. At this time, on the basis of the passage of time from when the passage of the front end Pl of the sheet P is detected by the sheet detecting sensor 60, and on the basis of the length from the front end Pl to the back end Pt of the sheet P (hereunder referred to as "sheet length") input by, for example, the UI 90, the controller 80 causes the transporting-in transporting section 300 to stop rotating, and causes the separating operation of the transporting-in transporting section 300 to be started at a timing in which a central position in its sheet length of the sheet P reaches the reversing-direction transport reference line Lb. As a result, in addition to each reversing driving roller 400*a* of the upstream-side reversing transporting section 400A, each transporting-in driving roller 300*a* of the transporting-in transporting section 300 no longer contacts the sheet P in the transport-in path Ra. As a result, the sheet P in the transport-in path Ra stops with its first side end Ps1 opposing the reversing path Rb and its sheet front surface Pf facing upward. At this time, the sheet P that is stopped in the transport-in path Ra is such that, regardless of its size and orientation, the central position in its sheet width overlaps the transporting-in direction transport reference line La and the central position in its sheet length overlaps the reversing-direction transport reference line Lb.

Next, the sheet P moves along the transfer direction Da2 in the transport-in path Ra. At this time, after the sheet P is stopped in the transport-in path Ra, the controller 80 causes the upstream-side reversing transporting section 400A to rotate and to start the contacting operation. This causes the rollers of the upstream-side reversing transporting section 400A to be set in the contact state and to start rotating at the transport-in path Ra. In contrast, at this time, at the transport-in path Ra, the rollers of the transporting-in transporting section 300 are set in a separated state and their rotation is stopped. Therefore, the sheet P that is stopped in the transport-in path Ra is moved along the transfer direction Da2 with the front side end Ps1 being the leading end and the sheet front surface Pf facing upward while the sheet P is nipped by the upstream-side reversing transporting section 400A. Here, in the exemplary embodiment, the transporting-in driven rollers 300*b* of the transporting-in transporting section 300 that are set in the separated state are kept in the transport-in path Ra (see FIG. 11A). However, since the resin rollers 3002*b* of each transporting-in transporting roller 300*b* are tapered (see FIG. 10A), each transporting-in driven roller 300*b* does not tend to interfere with the transportation of the sheet P in the transfer direction Da2.

In the exemplary embodiment, in response to the starting of the rotation and the contacting operation of the upstream-side reversing transporting section 400A, the rotation of the midstream-side reversing transporting section 400B and the rotation and the contacting operation of the downstream-side reversing transporting section 400C are started. This causes the rollers of the midstream-side reversing transporting section 400B to start rotating at the reversing path Rb. In addition, this causes the rollers of the downstream-side reversing transporting section 400C to be set in the contact state and to start rotating at the transport-out path Rc.

Then, the sheet P is moved from the inside of the transport-in path Ra to the inside of the reversing path Rb in the transfer direction Da2, and from the reversing path Rb to the transport-out path Rc in the reversing direction Db and the transfer direction Dc1. At this time, the rollers of the upstream-side reversing transporting section 400A are set in the contact state and are rotating at the transport-in path Ra. In addition, at this time, the midstream-side reversing transporting section 400B is rotating at the reversing path Rb. Further, at this time, the rollers of the downstream-side reversing transporting section 400C are set in the contact state and are rotating at the transport-out path Rc. In contrast, at this time, the rollers of the transporting-out transporting section 500 are set in a separated state and their rotation is stopped at the transport-out path Rc. Therefore, the sheet P that has entered the reversing path Rb from the transport-in path Ra is moved such that its leading side is moved along the reversing direction Db and its back end is moved along the transfer direction da2 with its first side end Ps1 being the leading end and its sheet surface Pf facing upward while the sheet P is nipped at the upstream-side reversing transporting section 400A and the midstream-side reversing transporting section 400B. In addition, the sheet P that has entered the reversing path Rb is moved along the reversing direction Db with its first side end Ps1 being the leading end and the state in which the sheet front surface Pf faces upward changing to the state in which the sheet back surface Pb faces upward while the sheet P is nipped at the midstream-side reversing transporting section 400B. Thereafter, the sheet P that has entered the transport-out path Rc from the reversing path Rb is moved so that its leading side is moved along the transfer direction Dc1 and its back end side is moved along the reversing direction with its first side end Ps1 being the leading end and its sheet back surface Pb facing upward while the sheet P is nipped at the downstream-side reversing transporting section 400C and the midstream-side reversing transporting section 400B. During the time in which the sheet P reaches the transport-out path Rc from the transport-in path through the reversing path Rb, the sheet P is transported so that the central position in its sheet length overlaps the reversing-direction transport reference line Lb. Here, in the exemplary embodiment, the transporting-out driven rollers 500*b* of the transporting-out transporting section 500 that are set in the separated state are kept in the transport-out path Rc (see FIG. 11E). However, since the resin rollers 5002*b* of each transporting-out driven roller 500*b* are tapered (see FIG. 10E), each transporting-out driven roller 500*b* does not tend to interfere with the transportation of the sheet P in the transfer direction Dc1.

Then, the sheet P is stopped in the transport-out path Rc. At this time, for example, on the basis of the passage of time from when the transportation of the sheet P is started by the upstream-side transporting section 400A, the controller 80 causes the downstream-side reversing transporting section 400C to stop rotating, and causes the separating operation of the downstream-side reversing transporting section 400C to be started at a timing in which the central position in its sheet width of the sheet P reaches the transport-out-direction transport reference line Lc. As a result, in addition to each transporting-out driving roller 500*a* of the transporting-out transporting section 500, each reversing driving roller 400*a* of the downstream-side reversing transporting section 400C no longer contacts the sheet P in the transport-out path Rc. As a result, the sheet P in the transport-out path Rc stops with its front end Pl opposing the fourth transport path R4 and its back surface Pb facing upward. At this time, the sheet P in the transport-out path Rc is such that, regardless of its size and orientation, the central position is sheet length overlaps the reversing-direction transport reference line Lb and the central position in its sheet length overlaps the transporting-out-direction transport reference line Lc.

Here, in the exemplary embodiment, the distance from the transporting-in direction transport reference line La at the transport-in path Ra to the transporting-out-direction transport reference line Lc at the transport-out path Rc through the reversing path Rb is determined independently of the size of the sheet P that is transported. Therefore, the period in which the sheet P is transported from the transport-in path Ra to the transport-out path Rc through the reversing path Rb is constant regardless of the size of the sheet P when the transport speed of the sheet P is constant.

In the exemplary embodiment, the controller 80 starts the rotation stoppage operation and the separating operation of the upstream-side reversing transporting section 400A and the rotation stoppage operation of the midstream-side reversing transporting section 400B in response to the starting of the rotation stoppage operation and the separating operation of the downstream-side reversing transporting section 400C. When these operations are started, the setting of the rollers of the upstream-side reversing transporting section 400A to the separated state and the stoppage of the rotation of the rollers of the upstream-side reversing transporting section 400A are started at the transport-in path Ra, and the midstream-side reversing transporting section 400E stops rotating at the reversing path Rb.

Next, the sheet P moves along the transport-out direction Dc2 in the transport-out path Rc. At this time, the controller 80 starts the rotation and the contacting operation of the transporting-out transporting section 500 after the controller 80 stops the sheet P in the transport-out path Rc. When these operations are started, the setting of the rollers of the transporting-out transporting section 500 to the contact state and the rotation of the rollers of the transporting-out transporting section 500 are started at the transport-out path Rc. In contrast, at this time, the rollers of the downstream-side reversing transporting section 400C are set in the separated state and their rotation is stopped at the transport-out path. Therefore, the sheet P that has been stopped in the transport-out path Rc moves along the transport-out direction Dc2 with its front end Pl being the leading end and its back surface Pb facing upward while the sheet P is nipped by the transporting-out transporting section 500. Thereafter, the sheet P is transported out to the fourth transport path R4 from the transport-out path Rc.

Here, in the exemplary embodiment, each reversing driven roller 400*b* of the downstream-side reversing transporting section 400C that is set in the separated state is kept in the transport-out path Rc (see FIG. 11D). However, since the resin rollers 4002*b* of each reversing driven roller 400*b* are tapered (see FIG. 10B), each reversing driven roller 400*b* does not tend to interfere with the transportation of the sheet P in the transport-out direction Dc2.

The controller 80 stops the rotation of the transporting-out transporting section 500 and starts the separating operation of the transporting-out transporting section 500 at a timing in which the sheet P is transported out of the transport-out path Rc. This causes the rollers of both of the downstream-side reversing transporting section 400C and the transporting-out transporting section 500 to be in a separated state at the transport-out path Rc.

Then, the sheet P whose front and back have been reversed by the sheet reversing device 100 is transported again from the fourth transport path R4 towards each image forming unit 10 and the fixing device 50 through the first transport path R1.

In the exemplary embodiment, the driving rollers (that is, the transporting-in driving rollers 300*a*, the reversing driving rollers 400*a*, and the transporting-out driving rollers 500*a*) retreat from both the transport-in path Ra or the transport-out path Rc of the sheet reversing device 100 due to the following reasons.

First, the driving rollers may receive outside rotational driving force. Therefore, when driving rollers that are not used for transporting a sheet P remain in a path, the driving rollers that are not used for transporting the sheet P may interfere with the transportation of the sheet P performed by the other driving rollers that are transporting the sheet P. In addition, in the exemplary embodiment, each driving roller includes rubber rollers whose coefficient of friction is higher than that of the resin rollers of each driven roller. Therefore, when driving rollers that are not used for transporting the sheet P remain in a transport path, the driving rollers that are not used for transporting the sheet P may interfere with the transportation of the sheet P performed by the other driving rollers that are transporting the sheet P. Consequently, in the exemplary embodiment, each driven roller including resin rollers are kept in its corresponding path, whereas each driving roller including rubber rollers retreat from its corresponding path.

Second Exemplary Embodiment

The basic structure according to the second exemplary embodiment is the same as that according to the first exemplary embodiment. In the first exemplary embodiment, the roller pairs of the transporting-in transporting section 300, the upstream-side reversing transporting section 400A, the downstream-side reversing transporting section 400, and the transporting-out transporting section 500 of the sheet reversing device 100 are such that the driving rollers retreat. However, in the second exemplary embodiment, both driving rollers and driven rollers retreat. In the second exemplary embodiment, components that correspond to those in the first exemplary embodiment are given the same reference numerals and will not be described in detail.

Figure 14A:
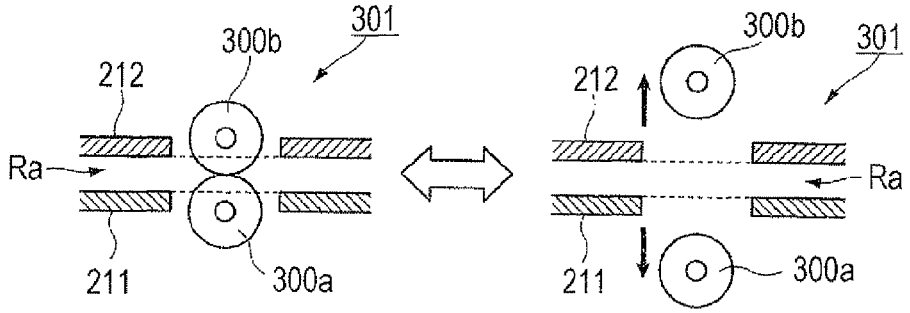
FIGS. 14A to 14E each illustrate the relationship between a pair of transport rollers and a corresponding transport path in a sheet reversing device.
Figure 14B:
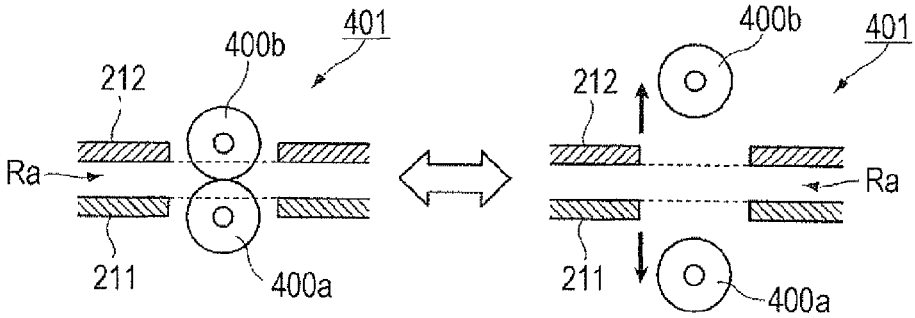
Figure 14C:
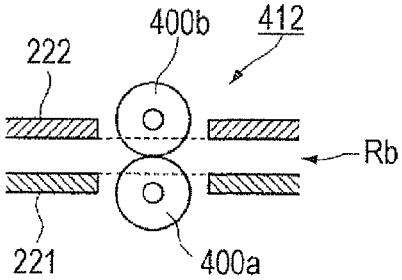
Figure 14D:
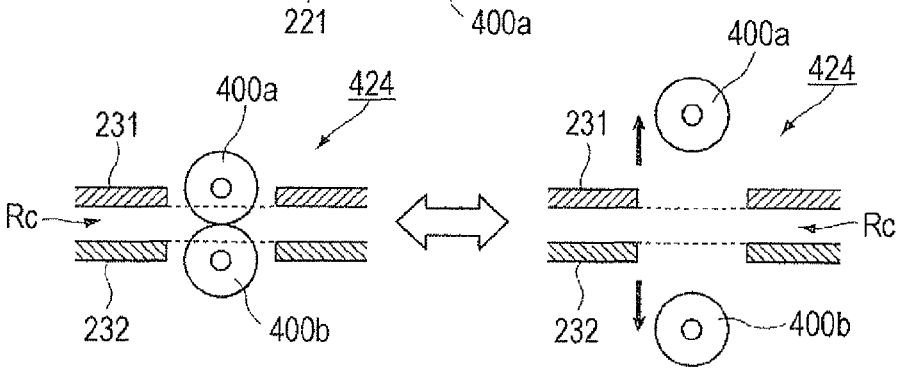
Figure 14E:
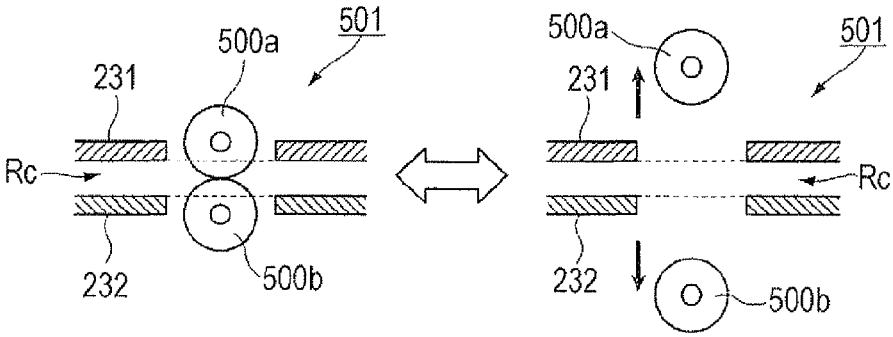

FIGS. 14A to 14E each illustrate the relationship between the pair of transport rollers and a corresponding transport path in the sheet reversing device 100 according to the exemplary embodiment. Here, FIGS. 14A to 14E correspond to FIGS. 10A to 10E. That is, FIG. 14A shows the relationship between a transport-in path Ra and a first transporting-in roller pair 301 at the transporting-in section 210. FIG. 14B shows the relationship between the transport-in path Ra and an upstream-side first reversing roller pair 401 at the transporting-in section 210. FIG. 14C shows the relationship between a reversing path Rb and the midstream-side second reversing roller pair 412 at a reversing section 220. FIG. 14D shows the relationship between a transport-out path Rc and a downstream-side fourth reversing roller pair 424 at a transporting-out section 230. FIG. 14E shows the relationship between the transport-out path Rc and a first transporting-out roller pair 501 at the transporting-out section 230.

As shown in FIG. 14A, a transporting-in driving roller 300*a* and a transporting-in driven roller 300*b* of the first transporting-in roller pair 301 are contactably and separably formed. When the transporting-in driving roller 300*a* and the transporting-in driven roller 300*b* of the first transporting-in roller pair 301 contact each other, both of the transporting-in driving roller 300*a* and the transporting-in driven roller 300*b* are in a state in which they are moved in the transport-in path Ra. In contrast, when the transporting-in driving roller 300*a* and the transporting-in driven roller 300*b* of the first transporting-in roller pair 301 are separated from each other, the transporting-in driving roller 300*a* and the transporting-in driven roller 300*b* are moved away from each other, so that both of the transporting-in driving roller 300*a* and the transporting-in driven roller 300*b* retreat from the transport-in path Ra. The rollers of a second transporting-in roller pair 302 to a sixth transporting-in roller pair 306 constituting the transporting-in transporting section along with the first transporting-in roller pair 301 contact and separate from each other as with the rollers of the first transporting-in roller pair 301.

As shown in FIG. 14B, a reversing driving roller 400*a* and a reversing driven roller 400*b* of the upstream-side first reversing roller pair 401 are contactably and separably formed. When the reversing driving roller 400*a* and the reversing driven roller 400*b* of the upstream-side first reversing roller pair 401 contact each other, both of the reversing driving roller 400*a* and the reversing driven roller 400*b* are in a state in which they are moved in the transport-in path Ra. In contrast, when the reversing driving roller 400*a* and the reversing driven roller 400*b* of upstream-side first reversing roller pair 401 are separated from each other, the reversing driving roller 400*a* and the reversing driven roller 400*b* are moved away from each other, so that both of the reversing driving roller 400*a* and the reversing driven roller 400*b* are retreated from the transport-in path Ra. The rollers of an upstream-side second reversing roller pair 402 to an upstream-side fourth reversing roller pair 404 constituting the upstream-side reversing transporting section 400A along with the upstream-side first reversing roller pair 401 contact and separate from each other as with the rollers of the upstream-side first reversing roller pair 401.

As shown in FIG. 14C, a reversing driving roller 400*a* and a reversing driven roller 400*b* of the midstream-side second reversing roller pair 412 are formed so as to be normally in contact with each other. Here, the reversing driving roller 400*a* and the reversing driven roller 400*b* are in a state in which they are moved in the reversing path Rb. The rollers of a midstream-side first reversing roller pair 411 and a midstream-side third reversing roller pair 413 constituting the midstream-side reversing transporting section 400B along with the midstream-side second reversing roller pair 412 are formed so as to be normally in contact with each other as with the rollers of the midstream-side second reversing roller pair 412.

As shown in FIG. 14D, a reversing driving roller 400*a* and a reversing driven roller 400*b* of the downstream-side fourth reversing roller pair 424 are contactably and separably formed. When the reversing driving roller 400*a* and the reversing driven roller 400*b* of the downstream-side fourth reversing roller pair 424 contact each other, both of the reversing driving roller 400*a* and the reversing driven roller 400*b* are in a state in which they are moved in the transport-out path Rc. In contrast, when the reversing driving roller 400*a* and the reversing driven roller 400*b* of the downstream-side fourth reversing roller pair 424 are separated from each other, the reversing driving roller 400*a* and the reversing driven roller 400*b* are moved away from each other, so that both of the reversing driving roller 400*a* and the reversing driven roller 400*b* are retreated from the transport-out path Rc. The rollers of a downstream-side first reversing roller pair 421 to a downstream-side third reversing roller pair 423 constituting the downstream-side reversing transporting section 400C along with the downstream-side fourth reversing roller pair 424 contact and separate from each other as with the rollers of the downstream-side fourth reversing roller pair 424.

As shown in FIG. 14E, a transporting-out driving roller 500*a* and a transporting-out driven roller 500*b* of the first transporting out roller pair 501 are contactably and separably formed. When the transporting-out driving roller 500*a* and the transporting-out driven roller 500*b* of the first transporting-out roller pair 501 contact each other, both of the transporting-out driving roller 500*a* and the transporting-out driven roller 500*b* are in a state in which they are moved in the transport-out path Rc. In contrast, when the transporting-out driving roller 500*a* and the transporting-out driven roller 500*b* of the first transporting-out roller pair 501 are separated from each other, the transporting-out driving roller 500*a* and the transporting-out driven roller 500*b* are moved away from each other, so that both of the transporting-out driving roller 500*a* and the transporting-out driven roller 500*b* are retreated from the transport-out path Rc. The rollers of a second transporting-out roller pair 502 to a sixth transporting roller pair 506 constituting the transporting-out transporting section 500 along with the first transporting-out roller pair 501 contact and separate from each other as with the rollers of the first transporting-out roller pair 501.

Figure 15B:
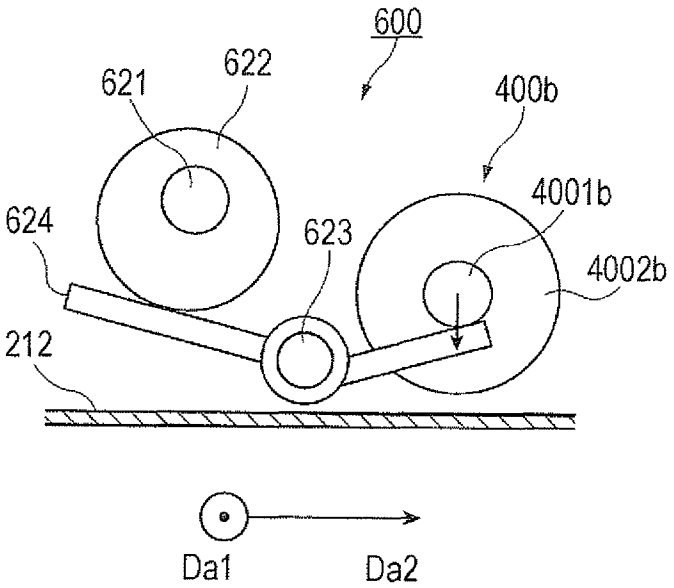
FIGS. 15A and 15B illustrate an exemplary structure of a rotating mechanism and an advancing/retreating mechanism of a pair of upstream-side first reversing rollers.
Figure 15A:
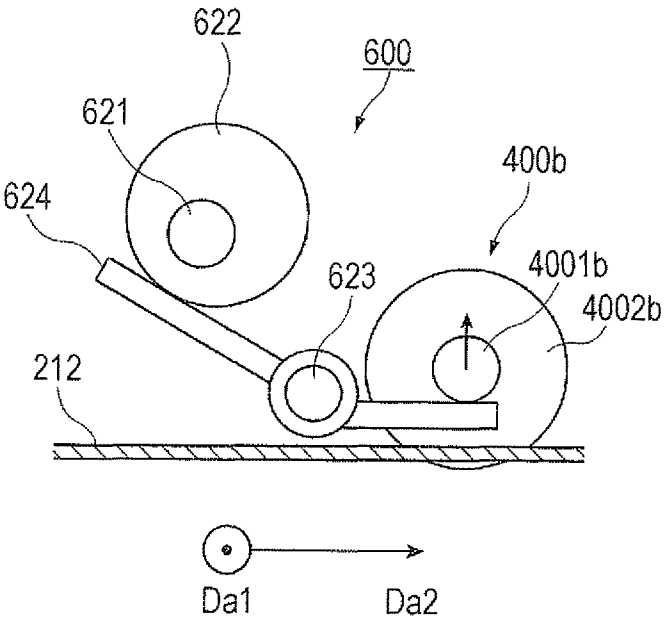

FIGS. 15A and 15B illustrate an exemplary structure of an advancing/retreating mechanism 600 that causes the upstream-side first reversing roller pair 401 to advance and retreat. Here, FIGS. 15A and 15B only show the reversing driven roller 400*b* of the upstream-side first reversing roller pair 401. The advancing/retreating mechanism 600 that causes the reversing driving roller 400*a* to advance and retreat and a rotating mechanism 700 that rotates the reversing driving roller 400*a* are similar to those described in the first exemplary embodiment (see FIGS. 12A to 12D). FIG. 15A shows the reversing driven roller 400*b* that is in contact with the reversing driving roller 400*a*, whereas FIG. 15B shows the reversing driven roller 400*b* that is separated from the reversing driving roller 400*a*.

The advancing/retreating mechanism 600 according to the exemplary embodiment includes a driven-side cam shaft 621, driven-side cams 622, a lever shaft 623, and a lever 624. The driven-side cam shaft 621 is mounted to, for example, a gear train 602 (see FIG. 12C) through, for example, a clutch. The driven-side cams 622 are mounted to two locations of the driven-side cam shaft 621 in an axial direction. The lever shaft 623 is secured and mounted to, for example, the second transporting-in guiding plate 212. The lever 624 is mounted so as to be rotatable around the lever shaft 623 as an axis, and is disposed so that one end side thereof contacts cam surfaces of the driven-side cams 622 and the other end side contacts a shaft 4001*b* of the reversing driven roller 400*b*.

Although, here, the upstream-side first reversing roller pair 401 are described as an example, the upstream-side second reversing roller pair 402 to the upstream-side fourth reversing roller pair 404 constituting the upstream-side reversing transporting section 400A along with the upstream-side first reversing roller pair 401 are each also provided with an advancing/retreating mechanism 600 and a rotating mechanism 700. The first transporting-in roller pair 301 to the sixth transporting-in roller 306 of the transporting-in transporting section 300, the downstream-side first reversing roller pair 421 to the downstream-side fourth reversing roller 424 of the downstream-side reversing transporting section 400C, and the first transporting-out roller pair 501 to the sixth transporting-out roller pair 506 of the transporting-out transporting section 500 are each also provided with an advancing/retreating mechanism 600 and a rotating mechanism 700. In contrast, the midstream-side first reversing roller pair 411 to the midstream-side third reversing roller pair 413 of the midstream-side reversing transporting section 400B are each provided with a rotating mechanism 700 for rotationally driving the corresponding roller pair, but are not provided with an advancing/retreating mechanism 600 for driving the corresponding roller pair causing it to advance and retreat.

In the exemplary embodiment, by using such a structure, when the driving rollers and the driven rollers of the roller pairs of the transporting-in transporting section 300, the upstream-side reversing transporting section 400A, the downstream-side reversing transporting section 400C, and the transporting-out transporting section 500 separate from each other, the driving rollers and the driven rollers of the roller pairs are capable of retreating from the respective transport paths. Therefore, when the transport and the sheet transport direction of a sheet P are changed in the transport-in path Ra and the transport-out path Rc, the tendency with which the transport roller pairs that are not used for transporting the sheet P interfere with the transport of the sheet P is further reduced. When the structure according to the exemplary embodiment is used, the driven rollers of the roller pairs of the transporting-in transporting section 300, the upstream-side reversing transporting section 400A, the downstream-side reversing transporting section 400C, and the transporting-out transporting section 500 no longer need to be tapered as they are tapered in, for example, FIGS. 10A and 10B and 10D and 10E.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material transporting device comprising:

a transport path for transporting a recording material, the recording material having a first side, a second side, a front side, and a back side, the second side being positioned opposite to the first side, the front side intersecting the first side, the back side being positioned opposite to the front side;

a first transporting section provided at the transport path, the first transporting section including a driving rotating member and a driven rotating member, the first transporting section nipping the recording material, and transporting the recording material in a first direction in which the front side of the recording material is a leading side;

a second transporting section provided at the transport path, the second transporting section including a driving rotating member and a driven rotating member, the second transporting section nipping the recording material that is transported by the first transporting section, and transporting the recording material in a second direction in which the first side of the recording material is a leading side;

wherein the driven rotating member of the second transporting section has a tapered portion at an upstream side in the first direction, a diameter of the tapered portion increasing in the first direction, wherein an end portion of the driving rotating member of the second transporting section disposed on an upstream side of the driving rotating member of the second transporting section along the first direction is provided upstream in the first direction as compared to an end portion of the tapered portion of the driven rotating member of the second transporting section disposed on a downstream side of the tapered portion of the driven rotating member of the second transporting section along the first direction, and wherein a gap between the driving rotating member of the second transporting section and the driven rotating member of the second transporting section is decreasing in the first direction.

2. The recording material transporting device according to claim 1, wherein the driven rotating member of the first transporting section has a tapered portion at an upstream side in the second direction, a diameter of the tapered portion increasing in the second direction, wherein a gap between the driving rotating member of the first transporting section and the driven rotating member of the first transporting section is decreasing in the second direction.

3. A transporting device comprising:

a transport path along which a recording material is transported, the recording material having a first side, a second side, a front side, and a back side, the second side being positioned opposite to the first side, the front side intersecting the first side, the back side being positioned opposite to the front side;

an input-side transporting section including an input-side driving rotating member and an input-side driven rotating member that are disposed opposite to each other with the transport path being interposed therebetween, the input-side driving rotating member rotating by receiving outside driving force, the input-side driven rotating member rotating by receiving the driving force from the input-side driving rotating member when the input-side driven rotating member is contacted by the input-side driving rotating member, the input-side transporting section nipping the recording material that is being transported into the transport path, and transporting the recording material in an input direction in which the front side of the recording material is a leading side; and an output-side transporting section including an output-side driving rotating member and an output-side driven rotating member that are disposed opposite to each other with the transport path being interposed therebetween, the output-side driving rotating member rotating by receiving outside driving force, the output-side driven rotating member rotating by receiving the driving force from the output-side driving rotating member when the output-side driven rotating member is contacted by the output-side driving rotating member, the output-side transporting section nipping the recording material that is being input to the transport path, and transporting the recording material in an output direction in which the first side of the recording material is a leading side, wherein the output-side driven rotating member of the output-side transporting section has a tapered portion at an upstream side in the input direction, a diameter of the tapered portion increasing in the input direction, wherein an end portion of the output-side driving rotating member disposed on an upstream side of the output-side driving rotating member along the input direction is provided upstream in the input direction as compared to an end portion of the tapered portion of the output-side driven rotating member disposed on a downstream side of the tapered portion of the output-side driven rotating member along the input direction and wherein a gap between the driving rotating member of the output-side transporting section and the driven rotating member of the output-side transporting section is decreasing in the input direction.

4. The transporting device according to claim 3, further comprising an input-side regulating section and an output-side regulating section, the input-side regulating section regulating further penetration of the input-side driven rotating member into the transport path, when the input-side driving rotating member of the input-side transporting section moves away from the input-side driven rotating member, the output-side regulating section regulating further penetration of the output-side driven rotating member into the transport path, when the output-side driving rotating member of the output-side transporting section moves away from the output-side driven rotating member.

5. The transporting device according to claim 3, wherein the input-side driven rotating member of the input-side transporting section has a tapered portion at an upstream side in the output direction, a diameter of the tapered portion increasing in the output direction, and wherein a gap between the driving rotating member of the input-side transporting section and the driven rotating member of the input-side transporting section is decreasing in the output direction.

6. An image forming apparatus comprising:

a transporting unit that transports a recording material along a transport path with a front side of the recording material being a leading side, the recording material having a first side, a second side, the front side, and a back side, the second side being positioned opposite to the first side, the front side intersecting the first side, the back side being positioned opposite to the front side; and an image forming section that forms an image on the recording material that is transported by the transporting unit;

wherein the transporting unit includes:

a first transporting section provided at the transport path, the first transporting section including a driving rotating member and a driven rotation member, the first transporting section nipping the recording material, and transporting the recording material in a first direction in which the front side of the recording material is a leading side; and a second transporting section provided at the transport path, the second transporting section including a driving rotating member and a driven rotating member, the second transporting section nipping the recording material that is transported by the first transporting section, and transporting the recording material in a second direction in which the first side of the recording material is a leading side;

wherein the driven rotating member of the second transporting section has a tapered portion at an upstream side in the first direction, a diameter of the tapered portion increasing in the first direction, wherein an end portion of the driving rotating member of the second transporting section disposed on an upstream side of the driving rotating member of the second transporting section along the first direction is provided upstream in the first direction as compared to an end portion of the tapered portion of the driven rotating member of the second transporting section disposed on a downstream side of the tapered portion of the driven rotating member of the second transporting section along the first direction, and wherein a gap between the driving rotating member of the second transporting section and the driven rotating member of the second transporting section is decreasing in the first direction.

* * * * *